US011298791B2

(12) United States Patent
Hagan et al.

(10) Patent No.: US 11,298,791 B2
(45) Date of Patent: Apr. 12, 2022

(54) METHOD AND SYSTEM FOR REMOVING MATERIAL FROM A WORKPIECE

(71) Applicants: SAINT-GOBAIN ABRASIVES, INC., Worcester, MA (US); SAINT-GOBAIN ABRASIFS, Conflans-Sainte-Honorine (FR)

(72) Inventors: John S. Hagan, Shrewsbury, MA (US); Robert J. McNamee, Windham, ME (US); Tony Landes, Bluff Dale, TX (US); Brian Rutkiewicz, Worcester, MA (US); William Lang, Carleton, MI (US); Mike D. Shappell, Henderson, KY (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 259 days.

(21) Appl. No.: 15/278,423

(22) Filed: Sep. 28, 2016

(65) Prior Publication Data

US 2017/0087684 A1 Mar. 30, 2017

Related U.S. Application Data

(60) Provisional application No. 62/234,021, filed on Sep. 28, 2015.

(51) Int. Cl.
*B24B 19/14* (2006.01)
*B24B 21/08* (2006.01)
(Continued)

(52) U.S. Cl.
CPC ..... *B24B 19/14* (2013.01); *B24B 21/08* (2013.01); *B24B 21/16* (2013.01); *B24D 11/00* (2013.01); *B24B 55/02* (2013.01)

(58) Field of Classification Search
CPC ..... B23Q 11/10; B24B 21/08; B24B 21/10; B24B 21/165; B24B 21/16; B24B 21/18; B24B 55/02; B24B 55/08
(Continued)

(56) References Cited

U.S. PATENT DOCUMENTS 1,826,177 A * 10/1931 Johnson ..... B24B 23/06 451/355
2,109,069 A * 2/1938 Lippold ..... B24B 21/16 451/296
(Continued)

FOREIGN PATENT DOCUMENTS

CA 2669870 A1 12/2010
DE 4414958 C1 11/1995
(Continued)

OTHER PUBLICATIONS

Tao Zhao "Surface roughness prediction and parameters optimization in grinding and polishing process for IBR of aero-engine" The International Journal of Advanced Manufacturing Technology, Sep. 2014, vol. 74, Issue 5-8, pp. 653-663.
(Continued)

*Primary Examiner* — Joel D Crandall
(74) *Attorney, Agent, or Firm* — Abel Schillinger, LLP; Joseph P. Sullivan

(57) ABSTRACT

A method of removing material from a workpiece includes moving a coated abrasive over a receiving surface of a platen, the receiving surface having at least one opening configured for the flow of an ejection material therethrough, moving the platen and workpiece relative to each other to contact the coated abrasive to the workpiece and removing material from the workpiece, and controlling a flow pressure for the ejection material through the at least one opening during removing material from the workpiece, where the flow pressure of the ejection material can be adjusted based
(Continued)

on at least one of the operation parameters such as a translation rate of the coated abrasive over the receiving surface, the weight of the coated abrasive, a material removal rate, a coefficient of friction between the coated abrasive and the platen, or a combination thereof.

18 Claims, 14 Drawing Sheets

(51) Int. Cl.
*B24B 21/16* (2006.01)
*B24D 11/00* (2006.01)
*B24B 55/02* (2006.01)

(58) Field of Classification Search
USPC ..... 451/303
See application file for complete search history.

(56) References Cited

U.S. PATENT DOCUMENTS 2,296,990 A * 9/1942 Fowler ..... B24B 21/00 451/303
2,677,922 A * 5/1954 McGuire ..... B24B 21/00 451/301
2,726,491 A * 12/1955 Smedley ..... B24B 21/165 451/168
2,755,604 A * 7/1956 Lambert ..... B24B 21/165 451/303
2,761,254 A * 9/1956 Lambert ..... B24B 21/165 451/303
2,934,863 A 5/1960 Pendergast
3,099,904 A * 8/1963 Bell ..... B24B 21/08 451/303
3,374,583 A * 3/1968 Jacobi ..... B24B 21/08 451/300
3,685,219 A * 8/1972 Palmenberg ..... B24B 21/165 451/59
3,911,627 A * 10/1975 Heesemann ..... B24B 21/08 451/299
4,031,668 A * 6/1977 Lasko ..... B24B 21/16 451/303
4,204,371 A * 5/1980 Horwitz ..... B24B 3/60 451/303
4,621,459 A * 11/1986 Stump ..... B23Q 15/02 451/300
4,651,474 A * 3/1987 David ..... B24B 21/22 451/300
4,656,790 A * 4/1987 Mukai ..... B24B 21/08 451/28
5,220,750 A * 6/1993 Emberland ..... B24B 21/10 451/300
5,295,329 A * 3/1994 Rothlisberger ..... B24B 21/10 451/303
5,443,415 A * 8/1995 Shebanow ..... B24B 7/17 451/296
6,627,098 B2 * 9/2003 Custer ..... B24B 37/30 134/25.4
6,752,898 B1 * 6/2004 Anderson, II ..... B24B 21/10 156/345.12
8,904,650 B2 * 12/2014 Floter ..... B26B 21/58 125/13.01
8,974,267 B2 3/2015 Pietsch et al.
2011/0237164 A1 * 9/2011 Seki ..... B24B 9/065 451/44
2012/0055096 A1 3/2012 Goldsmith et al.
2012/0178347 A1 6/2012 Joslin
2012/0322349 A1 10/2012 Josi
2012/0318190 A1 12/2012 Jost
2013/0059507 A1 * 3/2013 Breitenmoser ..... B24B 21/08 451/303
2015/0147528 A1 * 5/2015 Rose ..... B24B 21/02 428/156

FOREIGN PATENT DOCUMENTS

EP 1177858 A1 2/2002
GB 682447 A * 11/1952 ..... B24B 21/165
KR 20150104932 A 9/2015
TW 201440960 A 11/2014
TW I490934 B 7/2015
WO 0025982 A1 5/2000

OTHER PUBLICATIONS

Wlodzimierz Wilk "Modern technology of the turbine blades removal machining" The Institute of Advanced Manufacturing Technology, 30-011 Cracow, ul. Wroclawska 37a, Poland.
International Search Report for PCT/US2016/054100 dated Dec. 14, 2016, 12 pgs.
Supplementary European Search Report for EP16852448, dated May 22, 2019, 8 pages.

* cited by examiner

Quad
U234

Fine Tri-helical
U243

Tri-helical
U264

Pyramid
U254

METHOD AND SYSTEM FOR REMOVING MATERIAL FROM A WORKPIECE

CROSS-REFERENCE TO RELATED APPLICATION(S)

This application claims priority under 35 U.S.C. §119(e) to U.S. Patent Application No. 62/234,021 entitled "METHOD AND SYSTEM FOR REMOVING MATERIAL FROM A WORKPIECE," by John S. Hagan et al., filed Sep. 28, 2015, which is assigned to the current assignee hereof and incorporated herein by reference in its entirety.

FIELD OF THE DISCLOSURE

The following is directed to a method of removing material from a workpiece, and more particularly, a method of using a coated abrasive and platen to remove material from a workpiece.

DESCRIPTION OF THE RELATED ART

Gas turbine engines typically include a plurality of sections mounted in series. Two of the sections are the turbine section and the compressor section. These sections each include a plurality of rotors, each mounting a plurality of circumferentially spaced blades.

One recent development in gas turbine engines is the integrally-bladed rotor (IBR). Such components include a hub, which is attached to a drive shaft, and which includes a plurality of airfoils extending outwardly from the hub. There may be between 50 and 100 airfoils on a single integrally bladed rotor.

Each of these blades must be finished to demanding tolerances to ensure proper functioning of the rotors, and ultimately the engine. Generally, each of the blades is in form of an airfoil having a complex curvature, thus adding to the difficulty in the finishing process. Various grinding and/or machining operations have been utilized, including for example, the use of mounted point bonded abrasive tools designed to fit between the blades.

Accordingly, the industry continues to need improved abrasive tools and methods of finishing.

SUMMARY

According to one aspect, a method of removing material from a workpiece includes moving a coated abrasive over a receiving surface of a platen, the receiving surface comprising at least one opening configured for the flow of an ejection material therethrough; moving the platen and workpiece relative to each other to contact the coated abrasive to the workpiece and removing material from the workpiece; and controlling a flow pressure for the ejection material through the at least one opening during removing material from the workpiece, wherein the flow pressure of the ejection material is adjusted based on at least one of the operation parameters from the group of i) a translation rate of the coated abrasive over the receiving surface, ii) the weight of the coated abrasive, iii) a material removal rate, iv) a coefficient of friction between the coated abrasive and the platen, v) or a combination thereof.

In yet another aspect, a method of removing material from a workpiece includes moving a coated abrasive over a receiving surface of a platen, the receiving surface comprising at least one opening configured for the flow of an ejection material therethrough; moving the platen and workpiece relative to each other to contact the coated abrasive to the workpiece and removing material from the workpiece; and controlling a flow pressure for the ejection material through the at least one opening during removing material from the workpiece, wherein the flow pressure of the ejection material can be within a range of at least 1 psi and not greater than 100 psi.

According to another embodiment, a system for conducting a material removal operation includes a platen having a receiving surface including at least one opening configured for the flow of an ejection material therethrough; and a coated abrasive configured to be translated over the receiving surface of the platen; and movement assembly configured to move the platen relative to a workpiece and control a distance between the coated abrasive and the workpiece for a material removal operation.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 1:
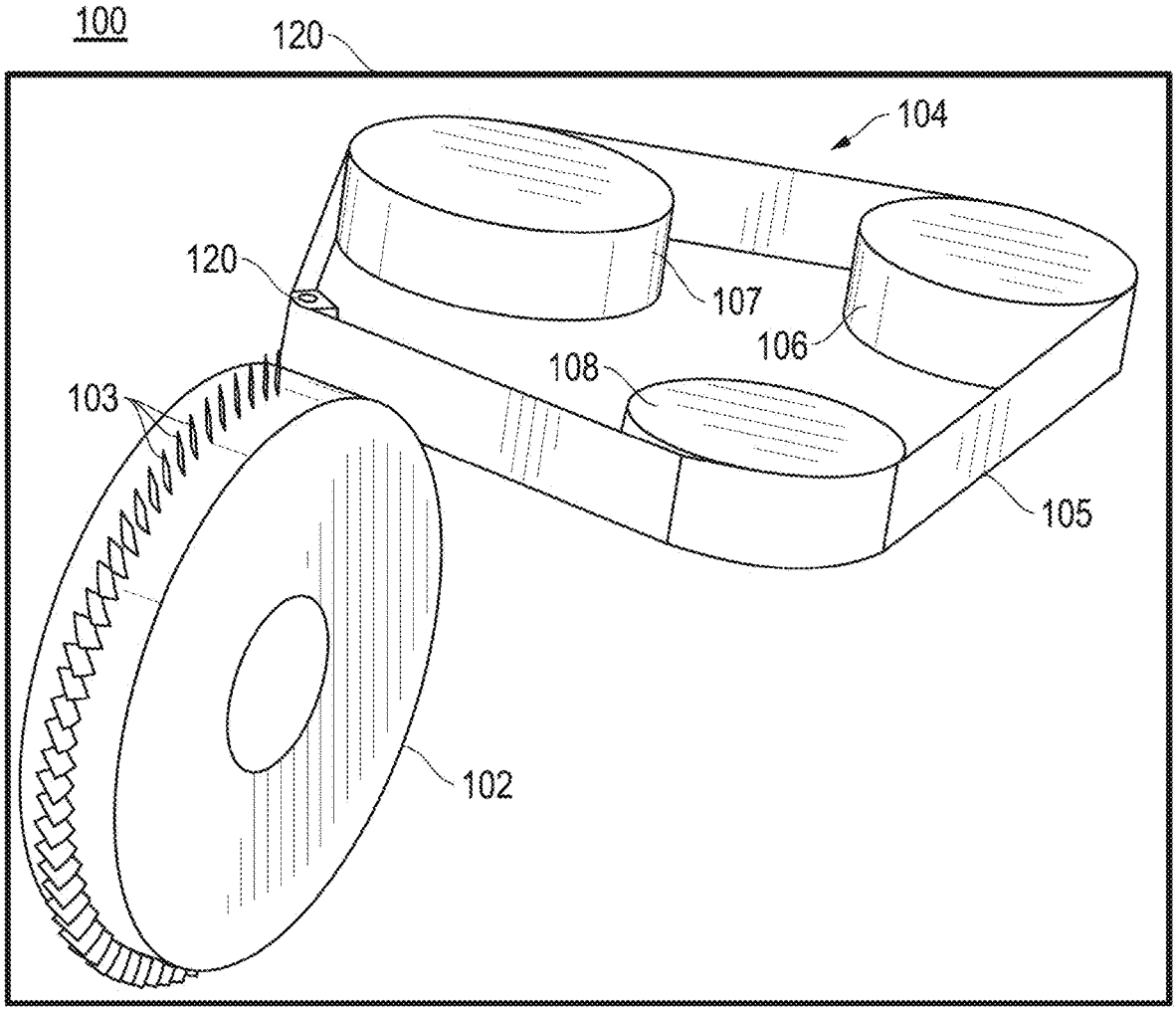
FIG. 1 includes a perspective view illustration of a system for removing material from a workpiece according to an embodiment.

The following is directed to abrasive articles, and particularly to a system employing an abrasive article and a method of using such a system for removing material from a workpiece. In at least one embodiment, the method may include using coated abrasive to finish complex surfaces of a workpiece. It will be appreciated that coated abrasives are a separate and distinct class from other abrasives (e.g. bonded abrasives, etc.) in that coated abrasives include a single layer of abrasive particles bonded to a substrate by one or more adhesive layers. Coated abrasives are considered distinct from bonded abrasive articles, which typically include a body of a three-dimensional shape including a dispersion of abrasive particles, bond material, and porosity throughout the entire three-dimensional volume of the body.

As used herein, the term "complex shape" refers to a shape (e.g., of a surface of a workpiece) or a shape of a part (e.g., a grinding surface of a grinding tool) that can have a contour defining a concave curvature, a convex curvature, a non-linear pathway, a pathway defining at least three distinct portions angled with respect to each other or a combination thereof. As further used herein, the term "complex shape" refers to at least one complex feature on a surface of a workpiece and may further refer to a combination of multiple complex features on a surface of a workpiece. For example, as will be described in more detail herein, the blades of a rotor can be in the shape of an airfoil defining a combination of concave and convex curvatures, and thus defining a complex surface.

The grinding methods described herein may be utilized in a variety of industries, including for example, construction, mining, aeronautics, naval architecture and construction, advanced machining applications, and the like.

The grinding methods described herein, including the grinding and finishing of complex shapes on workpiece surfaces, may be completed on certain types of workpiece materials including hard-to-grind materials. According to one embodiment, the workpieces of the embodiments herein can be metal or metal alloys. In one particular embodiment, the workpiece can include a metal material such as titanium, Inconel (e.g., IN-718), nickel alloys or nickel superalloy, steel-chrome-nickel alloys (e.g., 100 Cr6), carbon steel (AISI 4340 and AISI 1018) or a combination thereof. According to still other embodiments the workpiece may include at least about 50 wt % nickel alloy for the total weight of the workpiece, such as, at least about 60 wt % nickel alloy, at least about 70 wt % nickel alloy, at least about 80 wt % nickel alloy, at least about 90 wt % nickel alloy or even at least about 95 wt % nickel alloy for the total weight of the workpiece. In still other embodiments the workpiece may include not greater than about 100 wt % nickel alloy for the total weight of the workpiece, such as not greater than about 95 wt % nickel alloy, not greater than about 80 wt % nickel alloy, not greater than about 70 wt % nickel alloy or even not greater than about 60 wt % nickel alloy for the total weight of the workpiece. It will be appreciated that the workpiece may include any weight percent of nickel alloy within a range between any of the minimum and maximum values noted above. The workpiece can consist essentially of a metal or metal alloy, including any of the metal materials noted herein.

FIG. 1 includes a perspective view illustration of a system for removing material from a workpiece according to an embodiment. As illustrated, the system 100 can include a translation assembly 104 configured for translation of a coated abrasive 105. The translation assembly 104 may include one or more directional adapters, such as the directional adapters 106, 107, and 108. The directional adapters 106, 107, and 108 can be configured to direct the coated abrasive 105 in a predetermined path. As will be appreciated, the directional adapters 106, 107, and 108 can be spindles or wheels configured to rotated and facilitate translation of the coated abrasive 105. It will also be appreciated that alternative systems may incorporate a different number of directional adapters or other articles suitable for guiding the coated abrasive 105 along a suitable path.

Figure 3:
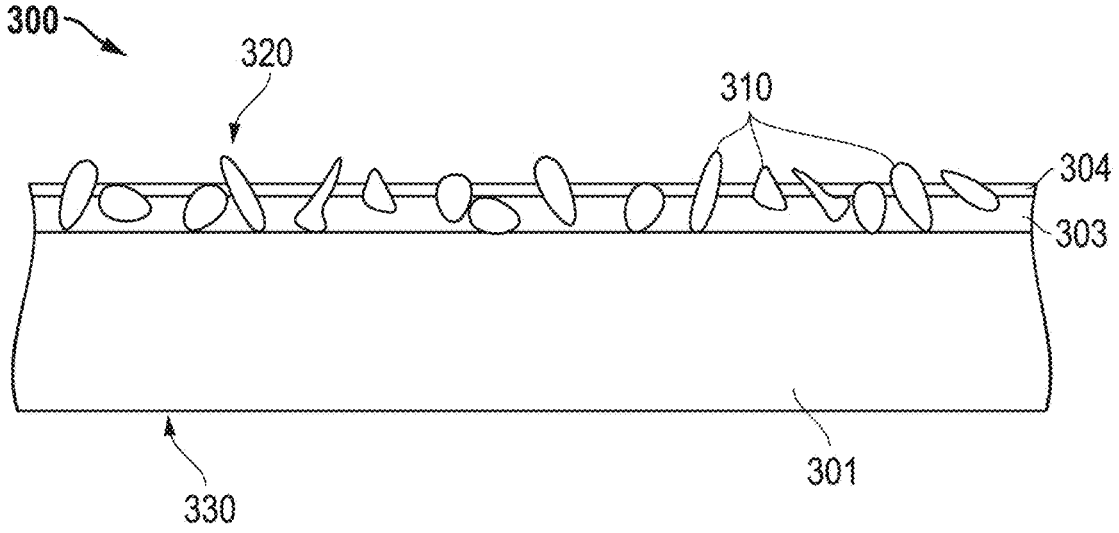
FIG. 3 includes a cross-sectional illustration of a coated abrasive article.

The coated abrasive can include abrasive particles adhered to a substrate or backing by at least one adhesive layer. Referring briefly to FIG. 3, a cross-sectional illustration of a coated abrasive article is provided. As illustrated, the coated abrasive article 300 can include a substrate 301 (e.g., a backing) and at least one adhesive layer overlying a surface of the substrate 301. The adhesive layer can include a make coat 303 and/or a size coat 304. The coated abrasive article 300 can include abrasive particles 310. The make coat 303 can be overlying the surface of the substrate 301 and surrounding at least a portion of the abrasive particles 310. The size coat 304 can be overlying and bonded to the abrasive particles 310. As illustrated, the abrasive particles 310 can be generally dispersed over the substrate 301 in a single layer.

According to one embodiment, the substrate 301 can include an organic material, inorganic material, and a combination thereof. In certain instances, the substrate 301 can include a woven material. However, the substrate 301 may be made of a non-woven material. Particularly suitable substrate materials can include organic materials, including polymers such as polyester, polyurethane, polypropylene, and/or polyimides such as KAPTON from DuPont, and paper. Some suitable inorganic materials can include metals, metal alloys, and particularly, foils of copper, aluminum, steel, and a combination thereof. The backing can include one or more additives selected from the group of catalysts, coupling agents, curants, anti-static agents, suspending agents, anti-loading agents, lubricants, wetting agents, dyes, fillers, viscosity modifiers, dispersants, defoamers, and grinding agents.

A polymer formulation may be used to form any of a variety of layers of the coated abrasive article 300 such as, for example, a frontfill, a pre-size, the make coat 303, the size coat 304, and/or a supersize coat. When used to form the frontfill, the polymer formulation generally includes a polymer resin, fibrillated fibers (preferably in the form of pulp), filler material, and other optional additives. Suitable formulations for some frontfill embodiments can include material such as a phenolic resin, wollastonite filler, defoamer, surfactant, a fibrillated fiber, and a balance of water. Suitable polymeric resin materials include curable resins selected from thermally curable resins including phenolic resins, urea/formaldehyde resins, phenolic/latex resins, as well as combinations of such resins. Other suitable polymeric resin materials may also include radiation curable resins, such as those resins curable using electron beam, UV radiation, or visible light, such as epoxy resins, acrylated oligomers of acrylated epoxy resins, polyester resins, acrylated urethanes and polyester acrylates and acrylated monomers including monoacrylated, multiacrylated monomers. The formulation can also comprise a nonreactive thermoplastic resin binder, which can enhance the self-sharpening characteristics of the deposited abrasive particles by enhancing the erodability. Examples of such thermoplastic resin include polypropylene glycol, polyethylene glycol, and polyoxypropylene-polyoxyethene block copolymer, etc. Use of a frontfill on the substrate 301 can improve the uniformity of the surface, for suitable application of the make coat 303 and improved application and orientation of shaped abrasive particles 305 in a predetermined orientation.

The make coat 303 can be applied to the surface of the substrate 301 in a single process, or alternatively, the abrasive particles 310 can be combined with a make coat 303 material and applied as a mixture to the surface of the substrate 301. Suitable materials of the make coat 303 can include organic materials, particularly polymeric materials, including for example, polyesters, epoxy resins, polyurethanes, polyamides, polyacrylates, polymethacrylates, polyvinyl chlorides, polyethylene, polysiloxane, silicones, cellulose acetates, nitrocellulose, natural rubber, starch, shellac, and mixtures thereof. In one embodiment, the make coat 303 can include a polyester resin. The coated substrate 301 can then be heated in order to cure the resin and the abrasive particulate material to the substrate. In general, the coated substrate 301 can be heated to a temperature of between about 100° C. to less than about 250° C. during this curing process.

The abrasive particles 310 can include any suitable type of abrasive particle, including for example, inorganic materials such as oxides, carbides, nitrides, borides, superabrasive materials, and a combination thereof. In one particular embodiment, the abrasive particles 310 may include shaped abrasive particles 305, which are understood in the art to be a specific class of particles that have a regular and repetitive two-dimensional and three dimensional shape relative to each other. Shaped abrasive particles may be formed through particular processes, including molding, printing, casting, extrusion, and the like. Shaped abrasive particles are formed such that each particle has substantially the same arrangement of surfaces and edges relative to each other for shaped abrasive particles having the same two-dimensional and three-dimensional shapes. As such, shaped abrasive particles can have a high shape fidelity and consistency in the arrangement of the surfaces and edges relative to other shaped abrasive particles of the group, generally having the same two-dimensional and three-dimensional shape. By contrast, non-shaped abrasive particles can be formed through different process and have different shape attributes. For example, non-shaped abrasive particles are typically formed by a comminution process, wherein a mass of material is formed and then crushed and sieved to obtain abrasive particles of a certain size. However, a non-shaped abrasive particle will have a generally random arrangement of the surfaces and edges, and generally will lack any recognizable two-dimensional or three dimensional shape in the arrangement of the surfaces and edges around the body. Moreover, non-shaped abrasive particles of the same group or batch generally lack a consistent shape with respect to each other, such that the surfaces and edges are randomly arranged when compared to each other. Therefore, non-shaped grains or crushed grains have a significantly lower shape fidelity compared to shaped abrasive particles. The coated abrasive may include shaped abrasive particles, non-shaped abrasive particles, or a combination thereof.

While not illustrated, the coated abrasive may include a combination of one or more types of abrasive particles. Moreover, one or more types of particles, abrasive or otherwise, may be applied to the backing 301, including for example, diluent particles. For example, diluent particles can differ from the abrasive particles 310 in composition, in two-dimensional shape, in three-dimensional shape, in size, or a combination thereof.

After sufficiently forming the make coat 303 with the abrasive particles 310, the size coat 304 can be formed to overlie and bond the abrasive particles 310 in place. The size coat 304 can include an organic material, may be made essentially of a polymeric material, and notably, can use polyesters, epoxy resins, polyurethanes, polyamides, polyacrylates, polymethacrylates, poly vinyl chlorides, polyethylene, polysiloxane, silicones, cellulose acetates, nitrocellulose, natural rubber, starch, shellac, and mixtures thereof.

Thus, as illustrated in FIG. 3, the coated abrasive 300 can include an abrasive surface 320, which relates to the surface on which the abrasive particles 310 are secured to the backing 301. The coated abrasive 300 can also include a non-abrasive surface 330, which is opposite the abrasive surface 320, and represents a surface of the backing that is essentially free of abrasive particles 310. As will be appreciated, the abrasive surface 320 is intended to contact the workpiece to conduct material removal operations. The non-abrasive surface 303 is configured to be adjacent to or contacting a portion of the platen 109 facilitating smooth translation of the coated abrasive 105 over the platen 109. One or more coatings of various materials may be applied to the non-abrasive surface 303 to facilitate suitable translation of the coated abrasive 105 over the platen 109.

Referring again to FIG. 1, the system 100 can further include a platen 109 configured to guide the coated abrasive 105 along a particular pathway for contacting at least a portion of the workpiece 102 to conduct a material removal operation. As illustrated, the system 100 can also include a workpiece 102, which in certain embodiments, may be a rotor with a plurality of blades 103 extending radially from the periphery of the rotor. The blades may be integrated with the rotor, such that it is considered an integrally-bladed-rotor. It will be appreciated that other workpieces may be utilized with the system, and the application of finishing a rotor is a non-limiting example.

Additionally, the system 100 can include a movement assembly 120, which can be coupled to the workpiece 102 and/or the translation assembly 104. The movement assembly 120 can be configured to move the workpiece 102 and/or the translation assembly 104 relative to each other to control a distance between the coated abrasive 105 and the workpiece 102 to facilitate the material removal operation. The movement assembly 120 may be manually operated, controlled by a computer, and/or automated.

Figure 2:
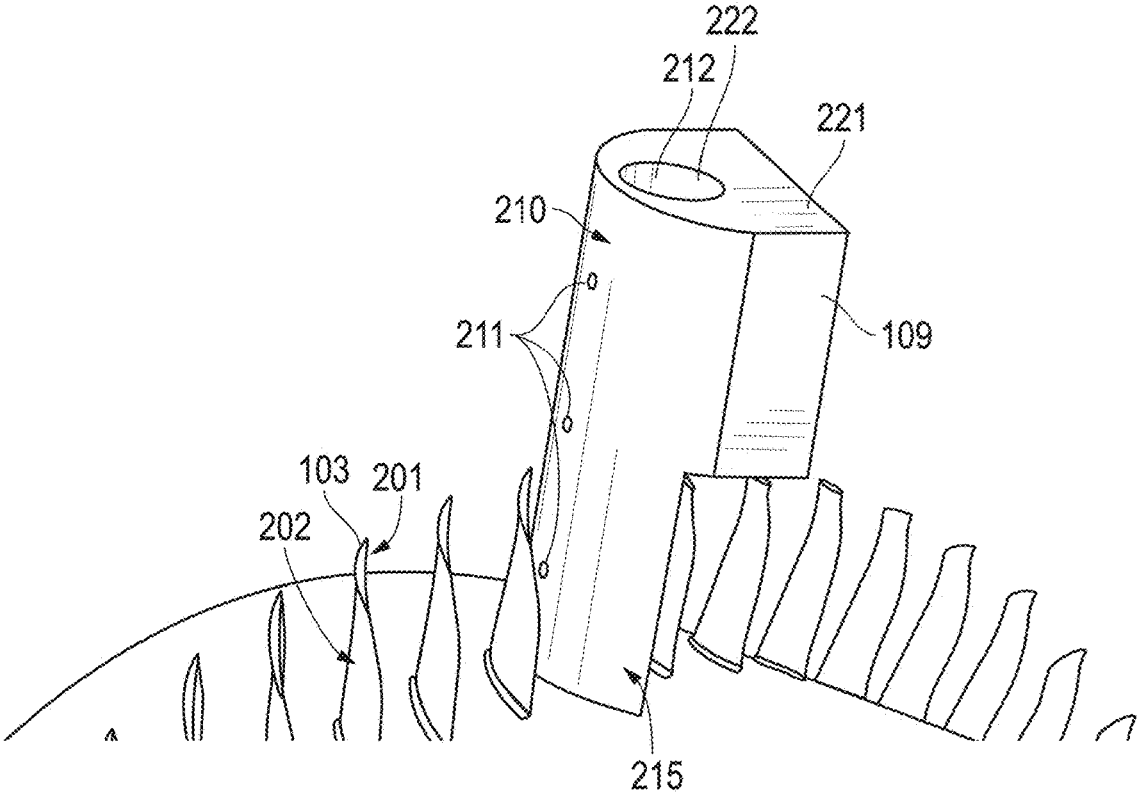
FIG. 2 includes a perspective view illustration of a portion of a rotor and a platen according to an embodiment.

FIG. 2 includes a perspective view illustration of a portion of a rotor and a platen according to an embodiment. Notably, FIG. 2 includes an illustration of the platen 109 positioned between the blades 103. The coated abrasive 105 has been removed to illustrate certain features of the platen 109. According to one embodiment, the platen 109 can have a receiving surface 210 configured to guide the coated abrasive 105 during the material removal operations.

In one embodiment, the receiving surface 210 of the platen 109 can have at least one opening configured for the flow of an ejection material there through. An ejection material may be supplied by any suitable means to the platen 109, and in particular, through an inlet 222 to an interior passageway 212 of the platen, such that the ejection material can be forcibly ejected from the one or more openings in the receiving surface 210. In the illustrated embodiment, of FIG. 2, the receiving surface 210 includes three openings 211 extending longitudinally along the length of the body. It will be appreciated that any number and size of openings may be use.

The openings are configured to allow an ejection material flow from an interior passageway 212 within the volume of the platen 109 out of the openings and contact a surface of the coated abrasive 105 during a material removal operation. According to one embodiment, the ejection material can be a gas, liquid, or a combination thereof. Some suitable examples of ejection material include air, a noble gas, an inert gas, an oxidizing gas, a reducing gas, nitrogen, carbon dioxide, or a combination thereof.

The ejection material may be cooled, such that upon ejection from the openings 211 during a material removal operation, the temperature of the ejection material is less than room temperature. For example, the ejection material can be at a temperature during ejection from the openings 211 of not greater than 25° C. or not greater than 10° C. or not greater than 0° C. or even not greater than −20° C.

During a material removal operation, the coated abrasive 105 is translated over the receiving surface 210 and over the openings 211. Certain aspects of the openings 211, including for example, but not limited to, the size, number of openings, shape of openings, location of the openings, may be utilized to facilitate proper translation of the coated abrasive over the receiving surface 210 while also facilitate suitable cooling of the coated abrasive 105 during the material removal operation.

In one embodiment, the platen 109 may be formed to include other features that may facilitate improved operations. For example, in one embodiment, the platen may be formed with one or more surface features to facilitate guiding of the coated abrasive over the receiving surface 210. The surface features may include one or more protrusions or depressions, including for example, grooves or channels in the receiving surface 210.

In yet another embodiment, during a material removal operation, the flow pressure of the ejection material through the openings 211 can be controlled and adjusted to facilitate improved operation. For example, the flow pressure of the ejection material can be adjusted to control the competing effects of cooling of the coated abrasive 105 and limiting the friction of the coated abrasive 105 against the receiving surface 210, while limiting uncontrolled shifting or turning of the coated abrasive on the receiving surface 210. In at least one embodiment, the flow pressure of the ejection material can be adjusted based on at least one operation parameter from the group including i) the translation rate of the coated abrasive 105 over the receiving surface 210, ii) the weight of the coated abrasive 105, iii) a material removal rate of the material removal operation, iv) a coefficient of friction between the coated abrasive 105 and the receiving surface 210 of the platen 109, v) tension on the coated abrasive, or a combination thereof.

According to one aspect, the flow pressure of the ejection material during the material removal operation can be at least 1 psi, such as at least 2 psi or at least 3 psi or at least 4 psi or at least 5 psi or at least 6 psi or at least 7 psi or at least 8 psi or at least 9 psi or at least 10 psi or at least 11 psi or at least 12 psi or at least 13 psi or at least 14 psi or at least 15 psi or at least 16 psi or at least 17 psi or at least 18 psi or at least 20 psi or at least 22 psi. Still, in another non-limiting embodiment, the flow pressure of the ejection material during the material removal operation can be not greater than 100 psi, such as not greater than 90 psi or not greater than 80 psi or not greater than 70 psi or not greater than 60 psi or not greater than 50 psi or not greater than 40 psi or not greater than 38 or not greater than 36 psi or not greater than 34 psi or not greater than 32 psi or not greater than 30 psi or not greater than 28 psi or not greater than 26 psi or not greater than 24 psi or not greater than 22 psi or not greater than 20 psi. It will be appreciated that the flow pressure of the ejection material during the material removal operation can be within a range including any of the minimum and maximum values noted above, including for example, within a range including at least 1 psi and not greater than 100 psi, or within a range including at least 5 psi and not greater than 40 psi or within a range including at least 8 psi and not greater than 22 psi. The flow pressure may be measured as the pressure measured at the device delivering the ejection material to the platen (e.g., a gas tank).

According to yet another embodiment, during a material removal operation, the flow pressure of the ejection material can be controlled relative to the translation rate of the coated abrasive 105 to facilitate improved operation. For example, in at least one embodiment, during a material removal operation, the process can include controlling a flow pressure relative to a translation rate of the coated abrasive within a specified value to facilitate improved grinding performance. In another embodiment, during a material removal operation, the process can include controlling a flow pressure relative to a tension on the coated abrasive across the receiving surface 210.

In yet another aspect, during a material removal operation, the flow pressure of the ejection material through the openings 210 can be adjusted to control a coefficient of friction between the receiving surface 210 and the coated abrasive 105, and particularly, the non-abrasive surface 330 of the coated abrasive 105. In certain instances, the coefficient of friction can be not greater than 100, such as not greater than 90 or not greater than 50 or not greater than 20 or not greater than 10 or not greater than 1.

Notably, in at least one embodiment, the flow pressure of the ejection material through the openings 210 during a material removal operation can be controlled such that the coated abrasive 105 has limited contact with the receiving surface 210. For example, in certain instances, the coated abrasive 105 is forced away from the receiving surface 210 by the ejection material flowing through the openings 211. As such, the coated abrasive may be spaced apart from the receiving surface 210 and the ejection material may form a gaseous and/or liquid layer between the receiving surface 210 and the coated abrasive 105. During material removal operations, depending on the force applied on the coated abrasive by the workpiece and the force applied on the coated abrasive by the ejection material, the coated abrasive may be in full or partial contact with the receiving surface 210.

As further illustrated in FIG. 2, in certain instances, the workpiece can include a rotor having a plurality of blades 103. The blades can have at least one non-linear contour, and more specifically, the blades can have a first surface 201 having a concave contour and a second surface 202 having a convex contour. It will be appreciated that the first surface 201 and second surface 202 do not have to have strictly concave or convex surfaces such that the surfaces define portions of a circle or sphere.

In one embodiment, the workpiece 102, and in particular, a first surface 201 of a blade 103 can have a curved surface defining a radius of curvature (RCw). The radius of curvature can be defined by the radius of a closest fit circle formed to the curvature of the surface. As further illustrated, the receiving surface 210 of the platen 109 may have a substantially complementary non-linear contour relative to the non-linear contour of the workpiece. More specifically, the receiving surface 210 of the platen 109 can have a substantially complementary radius of curvature (RCp) relative to the radius of curvature (RCw) of the workpiece. As used herein, substantially complementary means the difference in the radius of curvature between the workpiece (RCw) and the radius of curvature of the receiving surface 210 of the platen 109 (RCp) is not greater than 10%.

In at least one embodiment, the platen 109 can have a radius of curvature (RCp) smaller than the radius of curvature (RCw) of the workpiece. For example, the platen 109 can have a receiving surface 210 having a radius of curvature (RCp) that is at least 1% smaller than the radius of curvature (RCw) of the workpiece. For example, the receiving surface 210 of the platen 109 can have a radius of curvature (RCp) that is at least 2% smaller, such as at least 3% smaller or at least 5% smaller or at least 8% smaller or at least 10% smaller or at least 12% smaller or at least 15% smaller or at least 18% smaller or at least 20% smaller compared to the radius of curvature (RCw) of the workpiece. Still, in at least one embodiment, the difference in the radius of curvature between the workpiece (RCw) and the radius of curvature of the receiving surface 210 of the platen 109 (RCp) may be not greater than 90%, wherein the receiving surface 210 of the platen 109 has a smaller radius of curvature (RCp) relative to the radius of curvature (RCw) of the workpiece. For example, the receiving surface 210 of the platen 109 can have a radius of curvature (RCp) that is not greater than 80% smaller, such as not greater than 70% smaller or not greater than 60% smaller or not greater than 50% smaller or not greater than 40% smaller or not greater than 30% smaller or not greater than 20% smaller relative to the radius of curvature (RCw) of the workpiece. It will be appreciated that the receiving surface 210 of the platen 109 can have a radius of curvature (RCp) relative to the radius of curvature (RCw) of the workpiece within a range including any of the minimum and maximum percentages noted above.

According to one embodiment, the material removal operation can include moving the coated abrasive 105 into contact with the first surface 201 of the workpiece having a concave contour and removing material from the first surface 201. In the particular instance of finishing blades for a rotor, the platen can be sized and shaped such that it is capable of extending into a gap 215 between adjacent blades 103 on the rotor. The coated abrasive, which is extending over the receiving surface 210 of the platen 109 can be urged into contact with the first surface 201 having the concave contour. Notably, during a material removal operation on the first surface, at least a portion of the coated abrasive and a portion of the receiving surface 210 of the platen 109 can extend into a cavity defined by the concave contour of the first surface to make contact with the first surface and conduct the material removal operation. As such, in one embodiment, during the material removal operation on the first surface, the receiving surface 210 of the platen 109 can be immediately adjacent the first surface 201 having a concave contour, such that the receiving surface may be in indirect contact with the first surface 201, wherein the coated abrasive 105 is disposed in between and in direct contact with the first surface 201 and the receiving surface 210.

Furthermore, depending upon the contour of the first surface and the contour of the receiving surface, the platen and the coated abrasive may be moved in a controlled manner relative to the first surface. For example, the coated abrasive and platen may be oscillated in a lateral and/or longitudinal direction relative to the first surface 201. Moreover, the coated abrasive 105 and the platen 109 may be rotated around a longitudinal axis of the platen 109 to accomplish suitable material removal operations on the first surface 201.

After removing a sufficient amount of material from the first surface 201 and providing a suitable finish, the workpiece and/or the coated abrasive 105 can be moved relative to each other, such that the abrasive layer 320 of the coated abrasive 105 is in contact with the second surface 202 of the workpiece having a convex contour. The coated abrasive is moved over the second surface until a suitable amount of material is removed and/or a suitable finish is provided on the second surface.

According to one embodiment, during a material removal operation on the second surface 202 the platen may not necessarily be disposed entirely within a gap 215 between the blades 103. For example, the platen 109 can be placed adjacent to a blade 103 such that it guides the coated abrasive 105 over the second surface 202, but is laterally shifted and spaced apart from the second surface 202. In one instance, during removing material from the second surface 202 of the workpiece having a convex contour, the coated abrasive 105 may be translated over the second surface and deformed over the convex contour of the second surface 210. This can be distinct from the process utilized for removing material from the first surface 201, wherein the coated abrasive 105 is deformed over the receiving surface 210 of the platen.

Figure 4:
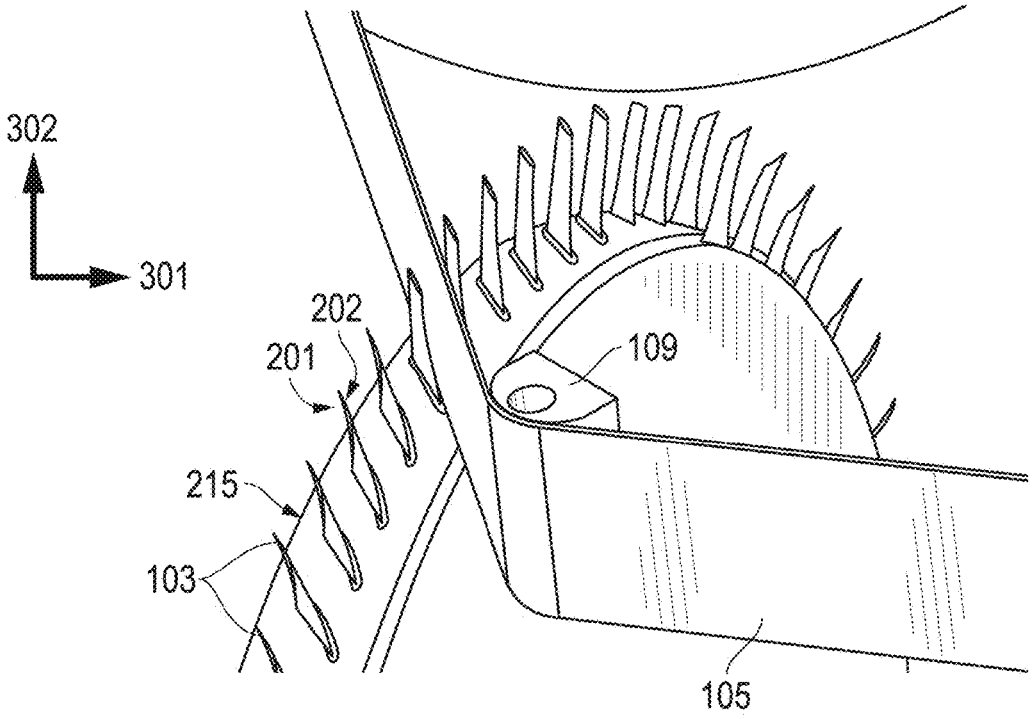
FIG. 4 includes a perspective view illustration of a portion of a rotor and a platen according to an embodiment.
Figure 5:
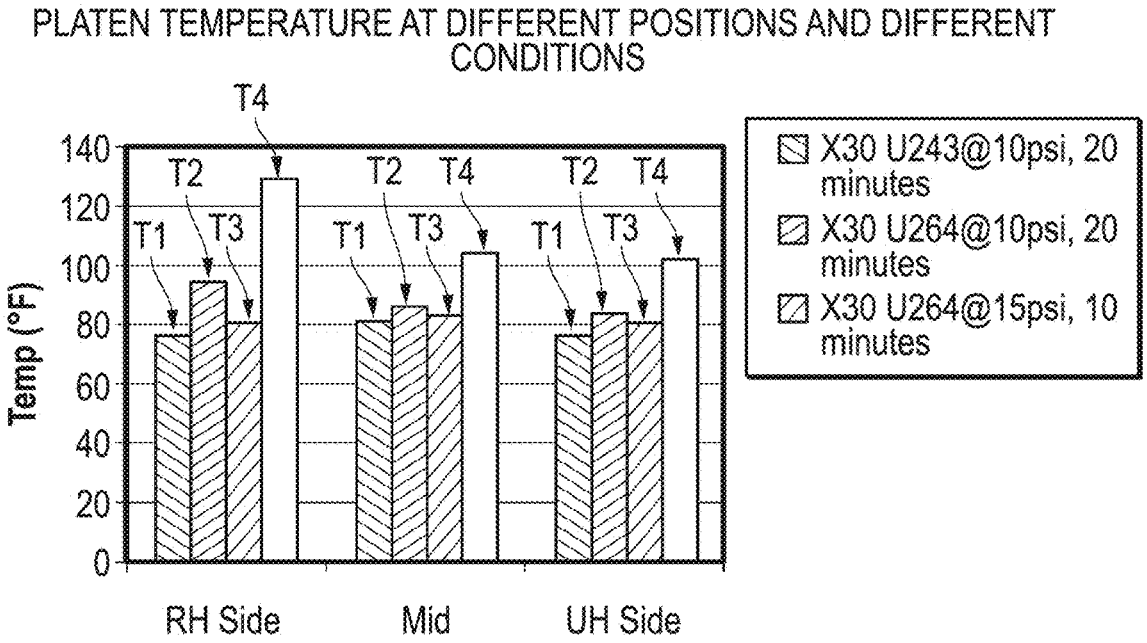
FIG. 5 includes a plot of temperature versus placement on the coated abrasive belt for samples utilizing a system including translation of a coated abrasive belt over a platen according to an embodiment.
Figure 6:
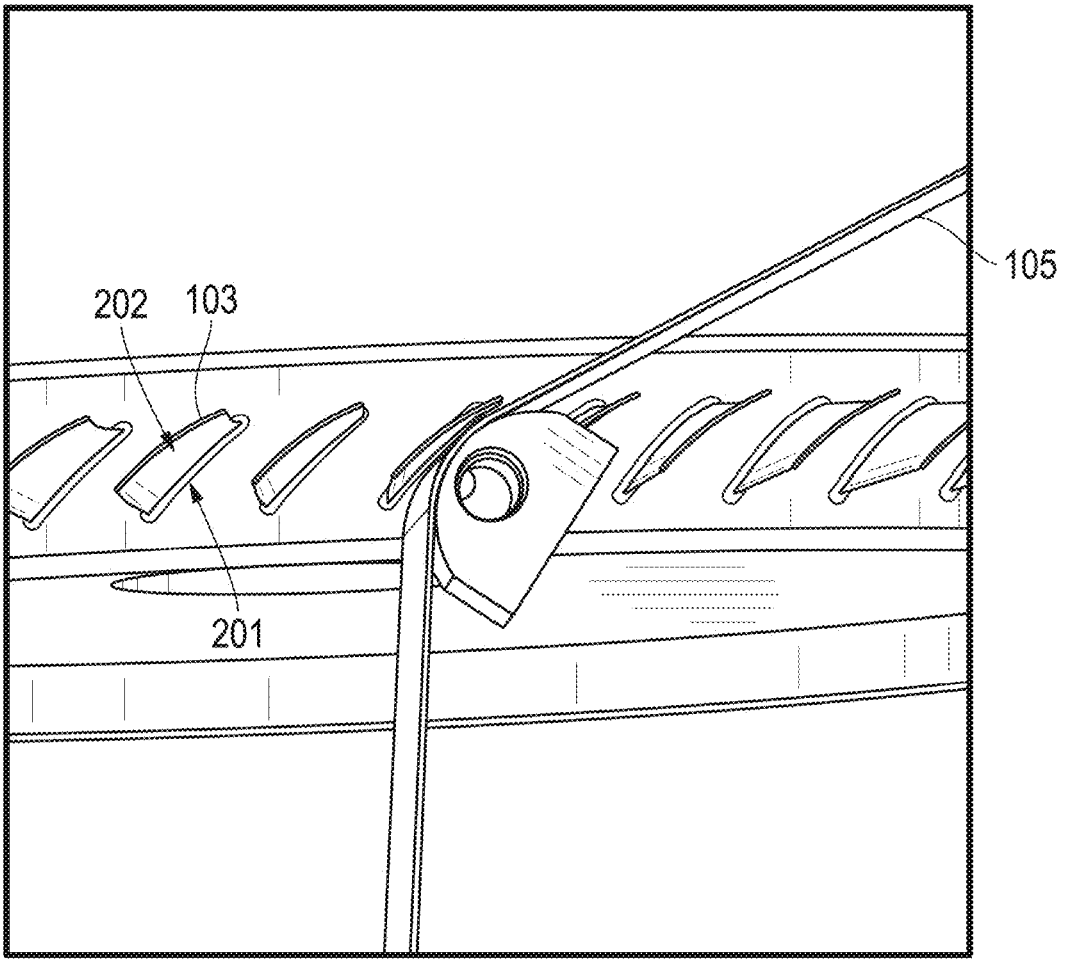
FIG. 6 includes a top-down view illustration of a portion of a rotor and a platen according to an embodiment.
Figure 7:
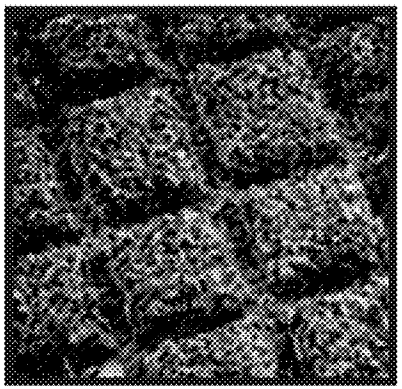
FIG. 7 includes images of different types of patterned coated abrasives that may be used according to an embodiment.
Figure 7:
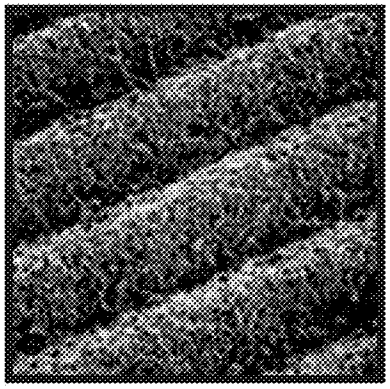
Figure 7:
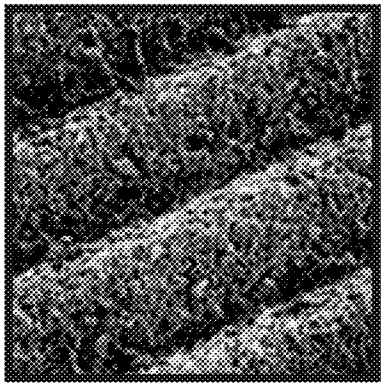
Figure 7:
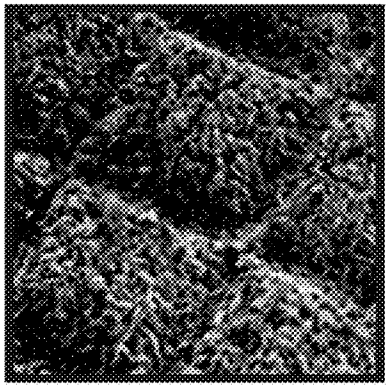
Figure 8:
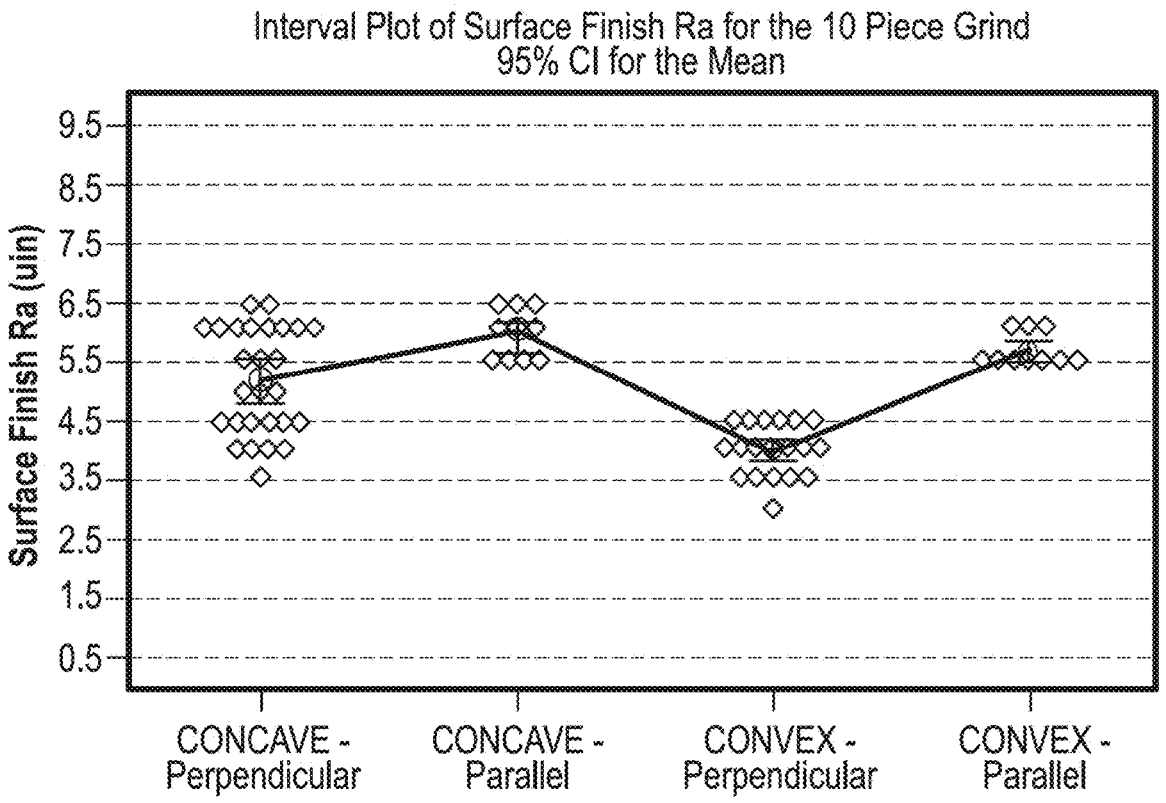
FIG. 8 includes a plot of surface finish for four samples according to an embodiment.
Figure 9:
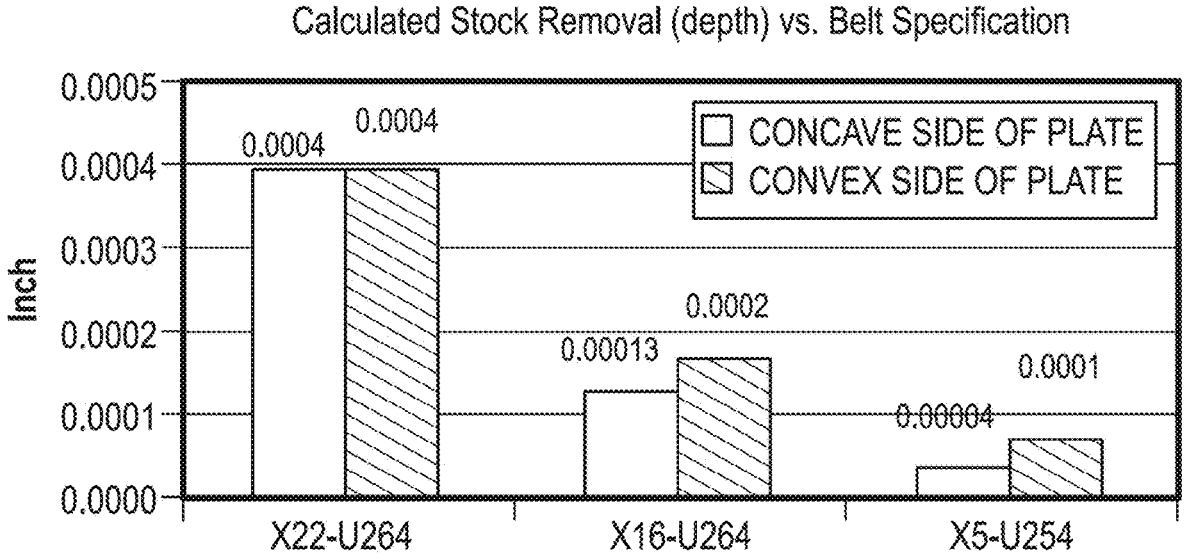
FIG. 9 includes a plot of cumulative stock removal for various coated abrasives according to an embodiment.
Figure 10:
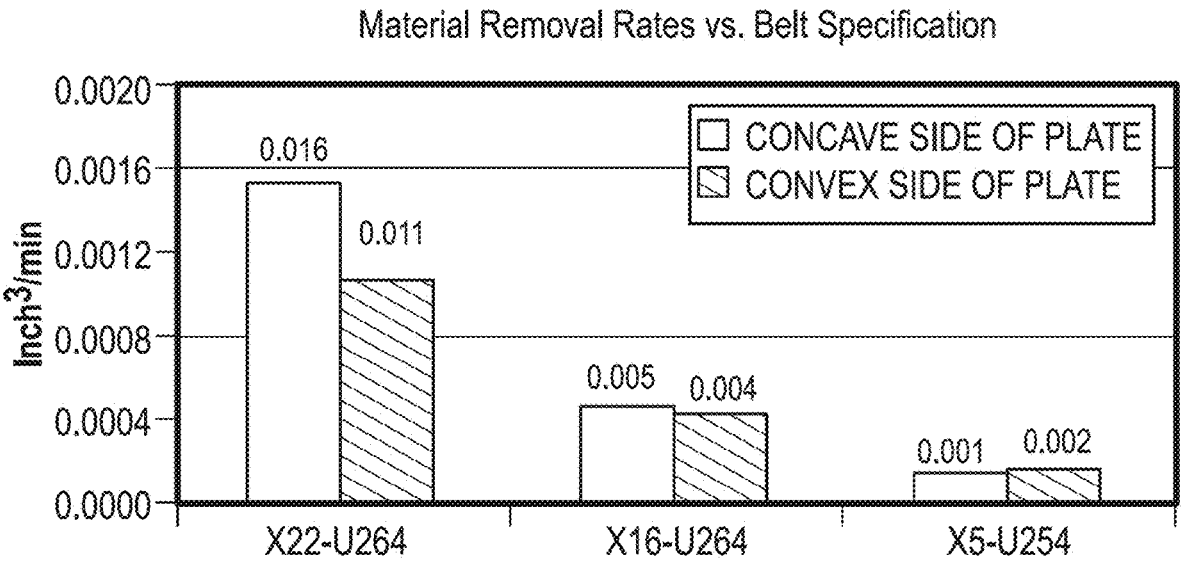
FIG. 10 includes a plot of cumulative stock removal for various coated abrasives according to an embodiment.
Figure 11:
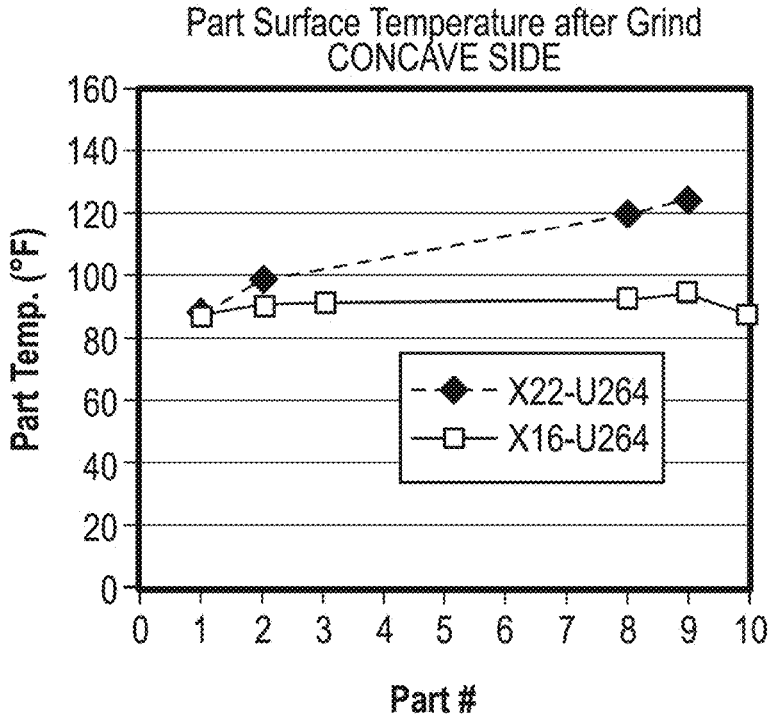
FIG. 11 includes a plot of the surface temperature of the workpiece after grinding on the concave side for two different coated abrasives according to an embodiment.
Figure 12:
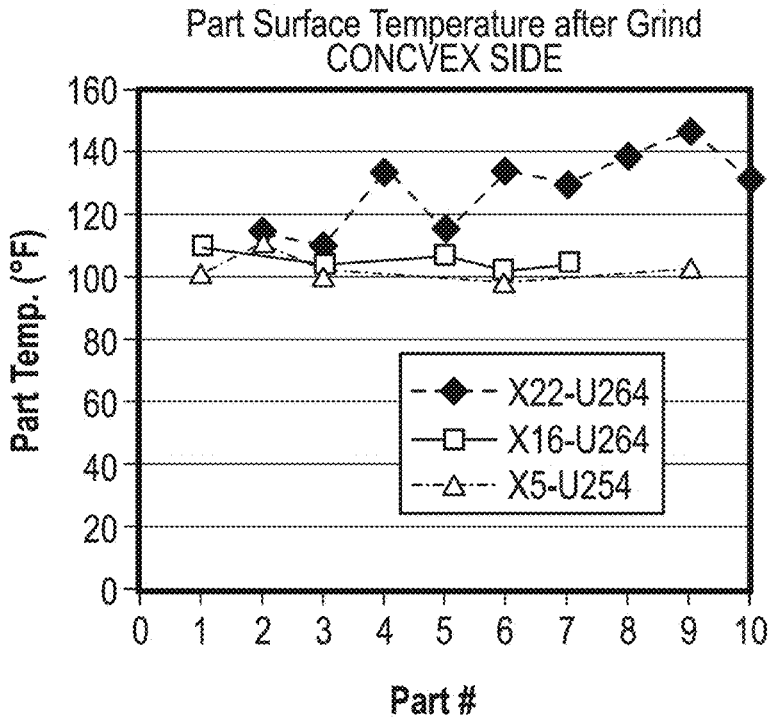
FIG. 12 includes a plot of the surface temperature of the workpiece after grinding on the convex side for three different coated abrasives according to an embodiment.

FIG. 5 includes a perspective view illustration of a system for removing material from a workpiece according to an embodiment. As illustrated, the platen can be laterally shifted in the lateral direction 301 perpendicular to the radial direction 302. The coated abrasive 105 can be translated over the receiving surface of the platen 109 and also within the gap 215 between the blades 103, such that the abrasive surface of the coated abrasive 105 contacts the second surface 202 of one of the blades 103, wherein the second surface 202 has a convex contour. Thus, as illustrated in FIG. 4, the platen 109 may not necessarily be disposed between the blades 103 during removing material from a second surface 202. Still, it will be appreciated that in alternative embodiments, at least a portion of the platen 109 can be disposed within the gap 215 between the blades 103.

It will be appreciated that while the process has described first removing material from a first surface and then a second surface, any of the surfaces of any of the blades 103 can be subject to a material removal operation in any order. Moreover, any of the operations utilized to conduct material removal operations on the first surface can be utilized in removing material from the second surface 202.

The process of moving the coated abrasive 105 relative to the workpiece 102 can be a manual process or automated process. A computer assisted assembly may be used to move the workpiece and/or the coated abrasive relative to each other to achieve the proper positioning of the coated abrasive relative to the workpiece to accomplish the material removal process.

Figure 13A:
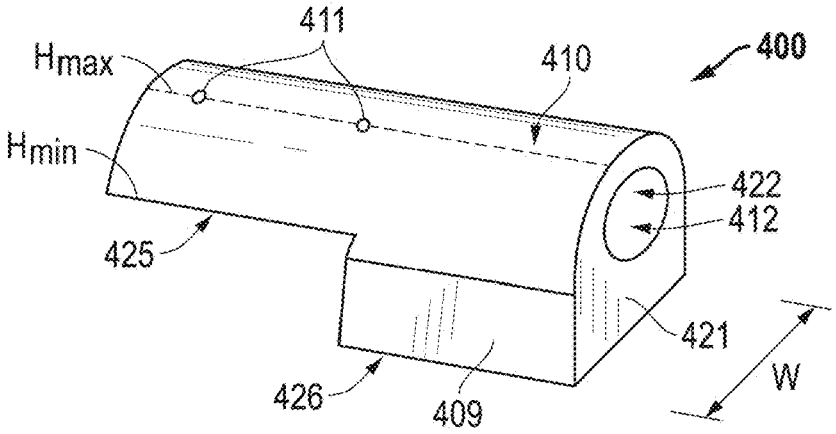
FIGS. 13A-13D include side perspective view illustrations of platens according to embodiments.

FIG. 13A includes a side perspective view illustration of a platen 400 according to an embodiment. The platen 400 can include a body 409 configured to guide a coated abrasive along a particular pathway for contacting at least a portion of a workpiece to conduct a material removal operation. According to one embodiment, the platen 400 can have a receiving surface 410 configured to guide a coated abrasive during the material removal operations.

In one embodiment, the receiving surface 410 of the platen 400 can have at least one opening 411 intersecting the receiving surface 410 and configured to allow for the flow of an ejection material there through. For example, the receiving surface 410 can include at least two openings 411, as generally illustrated in FIGS. 13A-13D. In some instances, the receiving surface 410 can have at least three openings, such as at least four openings, at least five openings, or even at least six openings. In a non-limiting embodiment, the receiving surface 410 can include not greater than 12 openings, such as not greater than 11 openings, not greater than 10 openings, not greater than nine openings, or even not greater than eight openings. It will be appreciated that the receiving surface 410 can have any number of openings in a range within any minimum or maximum number of openings 411 noted above.

Figure 13B:
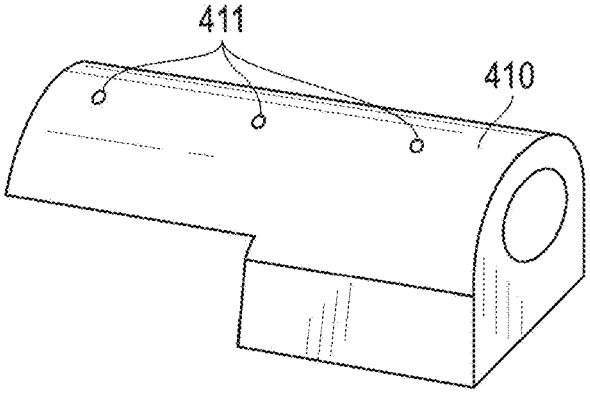
Figure 13C:
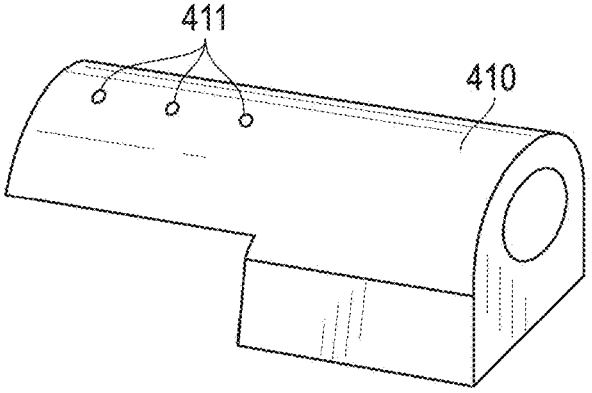
Figure 13D:
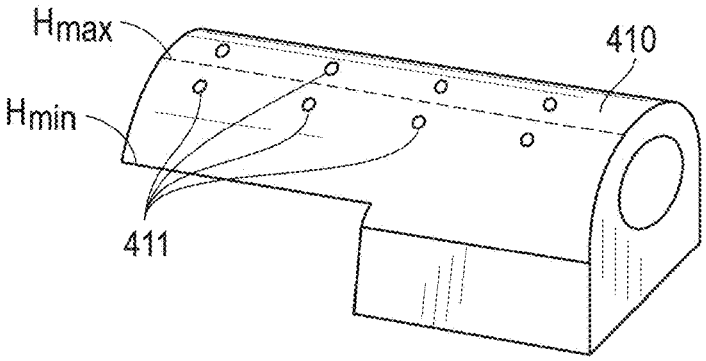

In some embodiments, the platen 400 can include at least three openings 411 positioned in a certain orientation with respect to each other. For example, as illustrated in FIGS. 13B and 13C, the platen 400 can include at least three openings 411 in a straight line with respect to each other. In one instance, as particularly illustrated in FIG. 13B, the openings 411 can be spaced apart from one another substantially equally along the entire axial length of the receiving surface 410. In another instance, as particularly illustrated in FIG. 13C, the openings 411 can be oriented in a straight line with respect to each other, and can be grouped together toward an axial end of the receiving surface 410. In a non-limiting embodiment including at least three openings 411, the three openings 411 can be positioned in a triangular orientation with respect to each other.

In some embodiments, the platen 400 can include at least four openings 411 positioned in a certain orientation with respect to each other. For example, the platen 400 can include at least four openings 411 that are positioned in a random orientation with respect to each other. In other embodiments, the platen 400 can include at least four openings 411 that are positioned in an L-shaped orientation, in a circular orientation, in a square orientation, or in a rectangular orientation with respect to each other.

Figure 16A:
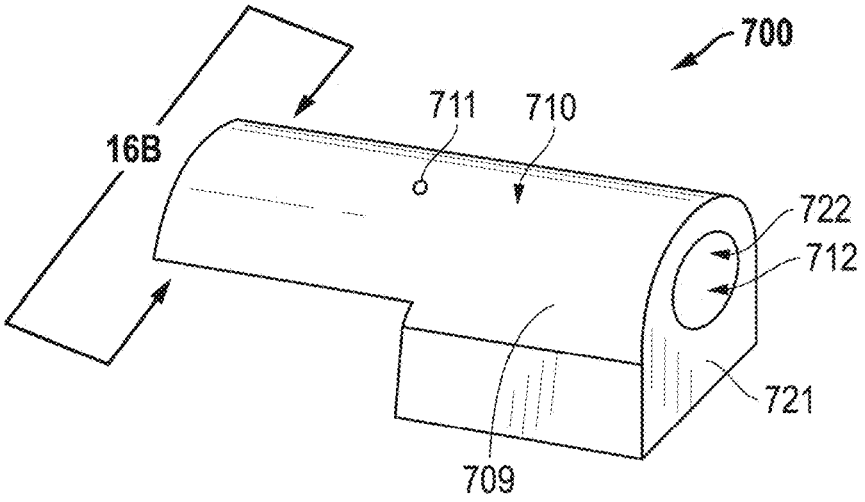
FIG. 16A includes a perspective view illustration of a platen according to an embodiment.
Figure 16B:
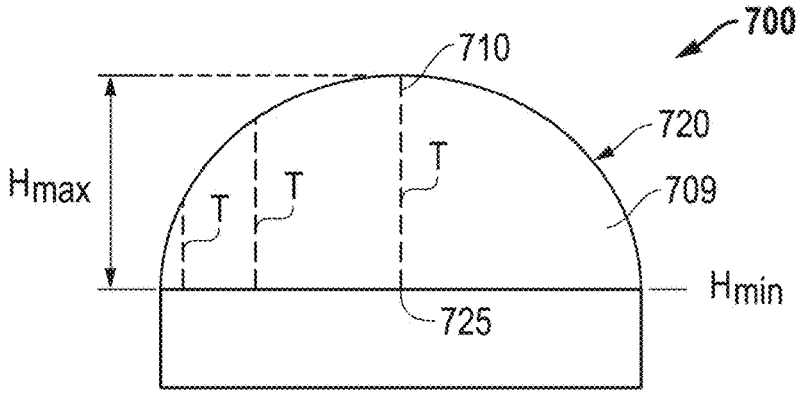
FIG. 16B includes a lateral cross-sectional illustration of a platen according to an embodiment.

In accordance with an embodiment, one or more openings 411 can be positioned at a particular location on the receiving surface 410 of the platen 400. Referring briefly to FIG. 16B, which includes a lateral cross-sectional illustration of a platen 700 according to an embodiment, the platen 700 can include a body 709 having a maximum height ($H_{max}$) defined as the maximum distance between a bottom surface 725 of the body 709 and a receiving surface 710 of the body 709. The body 709 can have a minimum height ($H_{min}$) defined as the minimum distance between a bottom surface 725 and the receiving surface 710 of the body 709. Referring generally back to FIGS. 13A-13D, one ore more of the openings 411 can be positioned between the minimum height ($H_{min}$) and the maximum height ($H_{max}$) of the receiving surface 410. As particularly illustrated in FIG. 13A, at least two of the openings 411 can be positioned at the maximum height ($H_{max}$) of the receiving surface 410. In a particular embodiment, all of the openings 411 can be positioned at the maximum height ($H_{max}$) of the receiving surface 410.

In accordance with an embodiment, the receiving surface of the platen can include a non-linear contour along a lateral cross-sectional plane of the body. For example, referring back to FIG. 16B illustrating a lateral cross-sectional view of the platen 700, the receiving surface 710 can include a non-linear contour along the lateral cross-sectional plane of the body 709. As particularly illustrated, the non-linear contour can be a generally convex contour.

Figure 17:
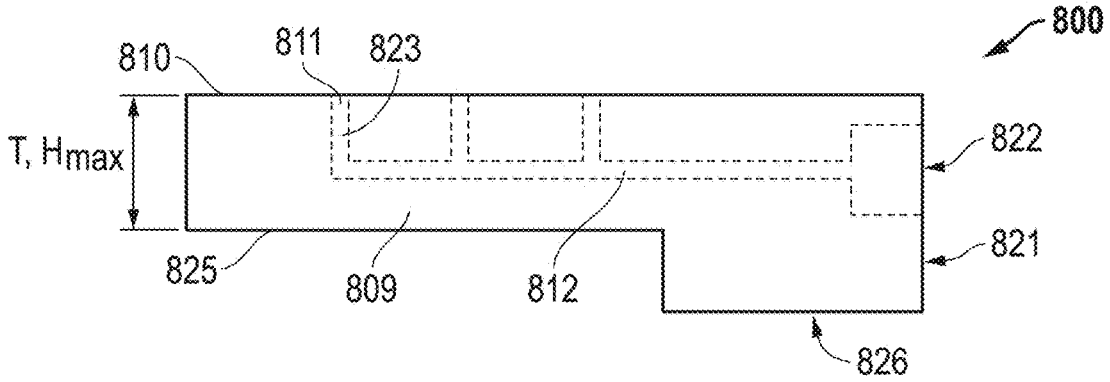
FIG. 17 includes a longitudinal cross-sectional illustration of a platen having an interior passageway according to an embodiment.

In accordance with an embodiment, the body 709 of the platen 700 can include a particular thickness (T). As illustrated in FIG. 16 B, the thickness (T) can be defined as the distance between the bottom surface 725 and the receiving surface 710 of the body 709 as viewed from a lateral cross-sectional plane of the body 709. In a particular embodiment, the thickness (T) can vary along the lateral cross-sectional plane of the body 709. FIG. 17 illustrates a longitudinal cross-sectional illustration of a platen 800 according to an embodiment. In a non-limiting embodiment as illustrated in FIG. 17, the thickness (T) may vary by only a limited amount along the longitudinal cross-sectional plane of the body 809 as measured from the bottom surface 825 and the receiving surface 810 of the body 809. For example, the thickness (T) may vary by not greater than 5 mm, such as not greater than 4 mm, not greater than 3 mm, not greater than 2 mm, not greater than 1 mm, not greater than 0.5 mm, or not greater than 0.1 mm. In a particular embodiment, the thickness (T) may substantially not vary along the longitudinal cross-sectional plane of the body 809 as measured from the bottom surface 825 and the receiving surface 810 of the body 809.

Referring back to FIG. 13A, the body 409 of the platen 400 can include an inlet 422 configured to provide ejection material to an interior passageway 412 within the body 409. The inlet 422 can be positioned at a particular location on the body 409. For example, the body 409 can have a side surface 421 and a back surface 426. The side surface 421 can be a distal end of the body 409, and can define the width (W) of the body 409. In an embodiment, the inlet 422 can be positioned on the side surface 421 of the body 409. In a particular embodiment, the inlet 422 is not positioned on the back surface 426 of the body 409. As particularly illustrated in FIG. 2, positioning the inlet 222 on the side surface 221 of the platen 109 may facilitate positioning the platen 109 between the blades 103.

Referring to FIG. 17, an ejection material may be supplied by any suitable means to the platen 800, and in particular, through an inlet 822 positioned on a side surface 821 of the body 809 to an interior passageway 812 disposed within the body 809, such that the ejection material can be forcibly ejected from the one or more openings 811 in the receiving surface 810.

The interior passageway 812 can be fluidly connected to at least one opening 811. In an embodiment, the interior passageway 812 can include at least one channel 823 that can intersect at least one opening 811. In an embodiment, the interior passageway 812 can include a plurality of channels 823. In an embodiment, each one of the plurality of channels 823 can intersect a separate opening 811. As particularly illustrated in FIG. 17, the interior passageway 812 is fluidly connected to three openings 811 through three channels 823, each channel 823 intersecting a separate one of the three openings 811.

In accordance with an embodiment, at least one of the channels 823 can include a different cross-sectional area compared to another one of the channels 823. For example, at least one of the channels 823 can include a cross-sectional area that is less than a cross-sectional area of another one of the channels 823. It will be appreciated that having a different cross-sectional area may facilitate maintaining a certain fluid pressure through the plurality of channels 823.

In accordance with an embodiment, the plurality of channels can include a first and a second channel. The first channel can include a cross-sectional width that is at least 1% less than a cross-sectional width of the first channel, such as at least 5% less, at least 10% less, at least 20% less, at least 30% less, at least 40% less, or at least 50% less. In a non-limiting embodiment, the first channel can include a cross-sectional width that is not greater than 99% less than a cross-sectional width of the first channel, such as not greater than 90% less, not greater than 80% less, not greater than 70% less, not greater than 60% less, or not greater than 50% less. It will be appreciated that the cross-sectional width of the first channel can be within any range of minimum or maximum values noted above.

In accordance with an embodiment, a channel can have a cross-sectional width that is at least the same as a diameter of an opening to which it is fluidly connected. For example, a channel can have a cross-sectional width that is at least 1% larger than a diameter of an opening to which it is fluidly connected, such as at least 5% larger, at least 10% larger, at least 20% larger, at least 30% larger, at least 40% larger, at least 50% larger. In a non-limiting embodiment, a channel can have a cross-sectional width that is not greater than 300% larger than a diameter of an opening to which it is fluidly connected, such as not greater than 250% larger, not greater than 200% larger, not greater than 150% larger, or not greater than 100% larger. It will be appreciated that the cross-sectional width of a channel within a range of any minimum or maximum value noted above with respect to a diameter of an opening to which it is fluidly connected.

Figure 15A:
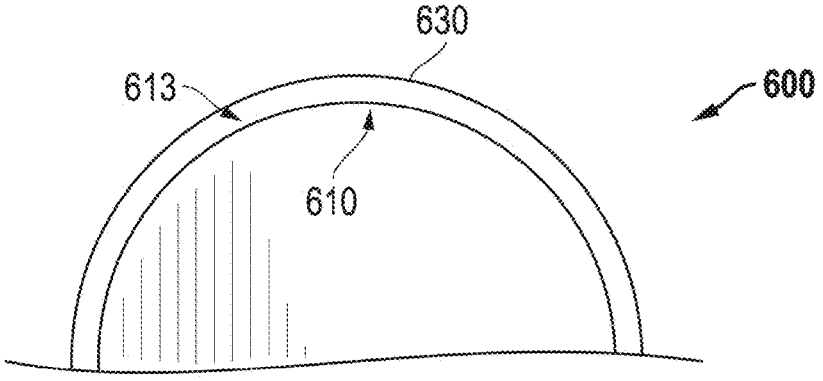
FIG. 15A includes a cross-sectional illustration of a platen having a coating comprising a single layer according to an embodiment.
Figure 15B:
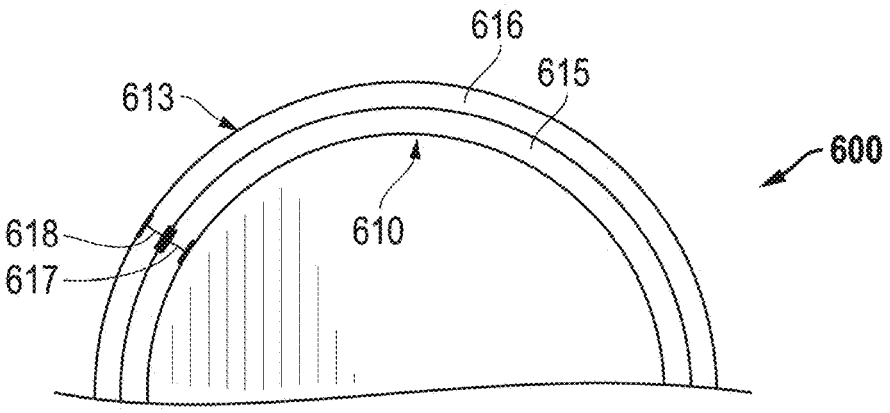
FIG. 15B includes a cross-sectional illustration of a platen having a coating comprising at least two layers according to an embodiment.
Figure 15C:
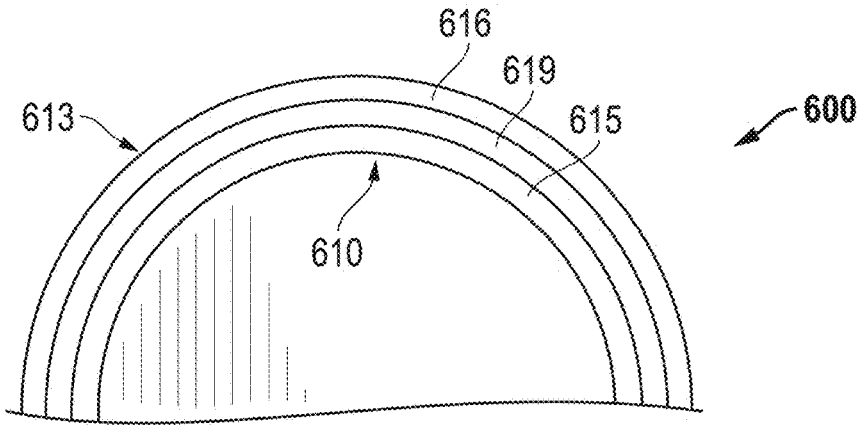
FIG. 15C includes a cross-sectional illustration of a platen having a coating comprising at least three layers according to an embodiment.

In accordance with an embodiment, a platen can include a coating disposed over at least a portion of the receiving surface of the platen. FIGS. 15A-15C include a cross-sectional illustration of a platen 600 having a coating 613 disposed over at least a portion of the receiving surface 610 of the platen 600. As particularly illustrated in FIG. 15A, platen 600 can include a coating 613 having a single layer 630 disposed over at least a portion of the receiving surface 610. According to other embodiment, the platen 600 can include a coating 613 having a plurality of layers. For example, as particularly illustrated in FIG. 15B, the platen 600 can include a coating 613 having at least two layers, including a first layer 615 overlying the receiving surface 610 and a second layer 616 overlying the first layer 615. The second layer 616 can be in direct contact with the first layer 615, and in a certain embodiment, the second layer 616 can be adhered to the first layer 615 via at least one adhesive. In another embodiment, as particular illustrated in FIG. 15C, the platen 600 can include a coating 613 having at least three layers, including a first layer 615 overlying the receiving surface 610, and a third layer 619 disposed between the first layer 615 and the second layer 616. The third layer 619 can be in direct contact with the first layer 615, and in a certain embodiment, the third layer 619 can be adhered to the first layer 615 via at least one adhesive. Similarly, the second layer 616 can be in direct contact with the third layer 619, and in in a certain embodiment, the second layer 616 can be adhered to the third layer 619 via at least one adhesive. It will be appreciated that the coating 613 can include a plurality of layers between the first layer 615 and the second layer 616.

In accordance with an embodiment, the coating 613 can include one or more materials. For example, the coating 613 can include a polymer, a metal, a ceramic, or any combination thereof. In a particular embodiment, the coating 613 can include a rubber material. In an embodiment, the polymer can be an elastic polymer. It will be appreciated that the coating 613 can consist essentially of a rubber material. In another embodiment, the coating 613 can include a carbon material, a polymer, or a combination thereof. In a particular embodiment, the carbon material can include graphite. In a particular embodiment, the coating 613 can consist essentially of a carbon material, and more particular, can consist essentially of graphite. In another particular embodiment, the coating 613 can consist essentially of a polymer material, and more particular, can consist essentially of polytetrafluorethylene (PTFE).

In accordance with an embodiment, the coating 613 can include a certain hardness. For example, the hardness of the coating can be defined by a Shore A hardness. In an embodiment, the coating 613 can include a Shore A hardness of not greater than 100A, such as not greater than 90A, not greater than 80A, not greater than 70A, not greater than 60A, not greater than 50A, not greater than 40A, or even not greater than 30A. In a non-limiting embodiment, the coating 613 can include a Shore A hardness of at least 20A, such as at least 30A, at least 40A, at least 50A, at least 60A, at least 70A, at least 80A, or even at least 90 A. It will be appreciated that the Shore A hardness of the coating 613 can be within a range of any minimum or maximum value noted above.

In accordance with an embodiment, the coating 613 can include a certain thickness. For example, the thickness of the coating 613 can be at least 1 mm, such as at least 2 mm, at least 3 mm, at least 4 mm, at least 5 mm, at least 10 mm, at least 20 mm, at least 30 mm, at least 40 mm, at least 50 mm, at least 60 mm, at least 70 mm, at least 80 mm, at least 90 mm, at least 100 mm, at least 120 mm, at least 140 mm, at least 160 mm, at least 180 mm, at least 200 mm, at least 220 mm, at least 240 mm, at least 260 mm, or at least 280 mm. In a non-limiting embodiment, the thickness of the coating 613 can be not greater than 300 mm, such as not greater than 280 mm, not greater than 260 mm, not greater than 240 mm, not greater than 220 mm, not greater than 200 mm, not greater than 180 mm, not greater than 160 mm, not greater than 140 mm, not greater than 120 mm, not greater than 100 mm, not greater than 80 mm, not greater than 60 mm, not greater than 40 mm, or not greater than 20 mm. It will be appreciated that the thickness of the coating 613 can be within a range of any minimum or maximum value noted above.

In accordance with an embodiment having a coating 613 with a plurality of layers, the first layer 615 of the coating can include one or more certain materials. For example, the first layer 615 can include a polymer, a metal, a ceramic, or any combination thereof. In particular embodiments, the first layer 615 can include a rubber material, an elastic polymer, felt, cork, leather, or a combination thereof. In other instances, the polymer can be an elastic polymer. In certain instances, the first layer 615 can include a rubber material, and in a particular embodiment, the first layer 615 can consist essentially of a rubber material.

In accordance with an embodiment having a coating 613 with a plurality of layers, the second layer 616 of the coating 613 can include one or more certain materials. For example, the second layer 616 can include a carbon material, a polymer material, or a combination thereof. In a particular embodiment, the second layer 616 can include graphite. In another particular embodiment, the second layer 616 can consist essentially of a polymer material, and more particular, can consist essentially of polytetrafluorethylene (PTFE). It will be appreciate that the second layer 616 can consist essentially of a carbon material, and more particular, can consist essentially of graphite. In a particular embodiment, the first layer 615 of the coating 613 can include a rubber material, and the second layer 616 of the coating 613 can include graphite. In another particular embodiment, the first layer 615 of the coating 613 can include a rubber material, and the second layer 616 of the coating 613 can include polytetrafluorethylene (PTFE).

In accordance with an embodiment having a coating with a plurality of layers, a third layer 619 of the coating 613 can include one or more materials. For example, the third layer 619 can include a polymer, a metal, a ceramic, a carbon material, or any combination thereof. In an embodiment, the polymer can be an elastic polymer. In one embodiment, the third layer 619 can include a carbon material that includes graphite. In another embodiment, the third layer 619 can include a polymer material that includes polytetrafluorethylene (PTFE).

In accordance with an embodiment having a plurality of layers, the first layer 615 of the coating 613 can include a certain hardness. For example, the first layer 615 of the coating 613 can include a hardness of not greater than 100A, such as not greater than 90A, not greater than 80A, not greater than 70A, not greater than 60A, not greater than 50A, not greater than 40A, or even not greater than 30A. In a non-limiting embodiment, the first layer 615 of the coating 613 can include a Shore A hardness of at least 20A, such as at least 30A, at least 40A, at least 50A, at least 60A, at least 70A, at least 80A, or even at least 90A. It will be appreciated that the Shore A hardness of the first layer 615 can be within a range of any minimum or maximum value noted above. In a particular embodiment, the Shore A hardness of the first layer 615 can be within a range of at least 20 and not greater than 90.

In accordance with an embodiment having a plurality of layers, the second layer 616 of the coating 613 can include a certain hardness. For example, the second layer 616 of the coating 613 can include a hardness of not greater than 100A, such as not greater than 90A, not greater than 80A, not greater than 70A, not greater than 60A, not greater than 50A, not greater than 40A, or even not greater than 30A. In a non-limiting embodiment, the second layer 616 of the coating 613 can include a Shore A hardness of at least 20A, such as at least 30A, at least 40A, at least 50A, at least 60A, at least 70A, at least 80A, or even at least 90A. It will be appreciated that the Shore A hardness of the second layer 616 can be within a range of any minimum or maximum value noted above.

In accordance with an embodiment having a plurality of layers, a third layer 619 of the coating 613 can include a certain hardness. For example, the third layer 619 of the coating 613 can include a hardness of not greater than 100A, such as not greater than 90A, not greater than 80A, not greater than 70A, not greater than 60A, not greater than 50A, not greater than 40A, or even not greater than 30A. In a non-limiting embodiment, a third layer 619 of the coating 613 can include a Shore A hardness of at least 20A, such as at least 30A, at least 40A, at least 50A, at least 60A, at least 70A, at least 80A, or even at least 90A. It will be appreciated that the Shore A hardness of a third layer 619 can be within a range of any minimum or maximum value noted above.

In accordance with an embodiment having a plurality of layers, the first layer 615 of the coating 613 can include a certain thickness 617. For example, the first layer 615 can include a thickness 617 of at least 1 mm, such as at least 2 mm, at least 3 mm, at least 4 mm, at least 5 mm, at least 10 mm, at least 20 mm, at least 30 mm, at least 40 mm, at least 50 mm, at least 60 mm, at least 70 mm, at least 80 mm, or even at least 90 mm. In a non-limiting embodiment, the first layer 615 can include a thickness 617 of not greater than 100 mm, such as not greater than 90 mm, not greater than 80 mm, not greater than 70 mm, not greater than 60 mm, not greater than 50 mm, not greater than 40 mm, not greater than 30 mm, not greater than 20 mm, not greater than 10 mm, or not greater than 5 mm. It will be appreciated that the first layer 615 can include a thickness 617 that is within a range of any minimum or maximum value noted above.

In accordance with an embodiment having a plurality of layers, the second layer 616 of the coating 613 can include a certain thickness 618. For example, the second layer 616 can include a thickness 618 of at least 1 mm, at least 2 mm, at least 3 mm, at least 4 mm, at least 5 mm. In a non-limiting embodiment, the second layer 616 can include a thickness 618 of not greater than 10 mm, such as not greater than 9 mm, not greater than 8 mm, not greater than 7 mm, not greater than 6 mm, not greater than 5 mm, not greater than 4 mm, not greater than 3 mm, of not greater than 2 mm. It will be appreciated that the second layer 616 can include a thickness 618 that is within a range of any minimum or maximum value noted above. In accordance with an embodiment, the second layer 616 can include a thickness 618 that is less than a thickness 617 of the first layer 615.

In accordance with an embodiment having a plurality of layers, a third layer 619 of the coating 613 can include a certain thickness. For example, a third layer 619 can include a thickness of at least 1 mm, such as at least 2 mm, at least 3 mm, at least 4 mm, at least 5 mm, at least 10 mm, such as at least 20 mm, at least 30 mm, at least 40 mm, at least 50 mm, at least 60 mm, at least 70 mm, at least 80 mm, or even at least 90 mm. In a non-limiting embodiment, a third layer 619 can include a thickness of not greater than 100 mm, such as not greater than 90 mm, not greater than 80 mm, not greater than 70 mm, not greater than 60 mm, not greater than 50 mm, not greater than 40 mm, not greater than 30 mm, not greater than 20 mm, not greater than 10 mm, not greater than 9 mm, not greater than 8 mm, not greater than 7 mm, not greater than 6 mm, not greater than 5 mm, not greater than 4 mm, not greater than 3 mm, of not greater than 2 mm. It will be appreciated that a third layer 619 can include a thickness that is within a range of any minimum or maximum value noted above.

In accordance with an embodiment having a coating with a plurality of layers, the second layer 616 can include a certain coefficient of friction. In certain embodiment, the second layer 616 can include a coefficient of friction of not greater than 0.5, such as not greater than 0.4, not greater than 0.3, not greater than 0.2, not greater than 0.1, or not greater than 0.05. It will be appreciated that the coefficient of friction of the second layer 616 can be within a range of any minimum or maximum value noted above.

Figure 14B:
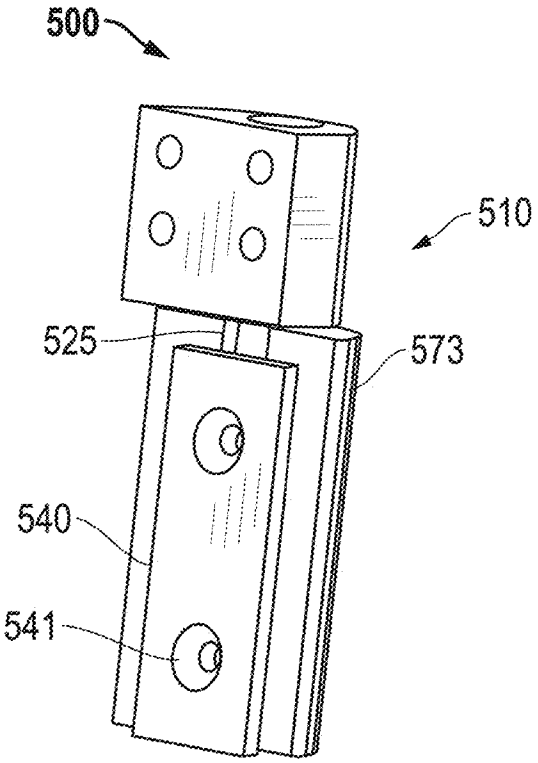
FIG. 14B includes a bottom-up perspective view illustration of the platen of FIG. 14A.
Figure 14A:
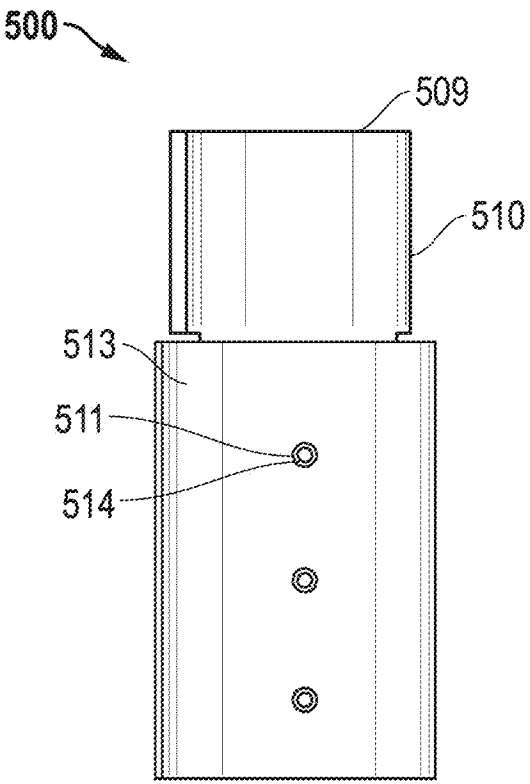
FIG. 14A includes a top-down perspective view illustration of a platen having a coating according to an embodiment.

FIG. 14A includes a top-down perspective view illustration of a platen 500 having a coating 513 disposed over at least a portion of the receiving surface 510 of the platen 500, according to an embodiment. As illustrated, the coating 513 can include at least one opening 514 corresponding with the at least one opening 511 on the receiving surface 510 of the body 509 of the platen 500. The coating 513 can be disposed over substantially the entire receiving surface 510, except for one or more openings 514 corresponding to one or more openings 511 on the receiving surface 510. In certain embodiments, the coating 513 can cover less than the entire receiving surface 510. In particular, the coating 513 can include a single continuous coating that covers less than the entire receiving surface 510. The single continuous coating can be in any shape, including a strip, rectangle, circle, or any combination thereof. In yet other embodiments, the coating 513 can include a plurality of discontinuous portions, and the discontinuous portions of coating ca be in any shape, such as strips, rectangles, circles, or any combination thereof.

Figure 18B:
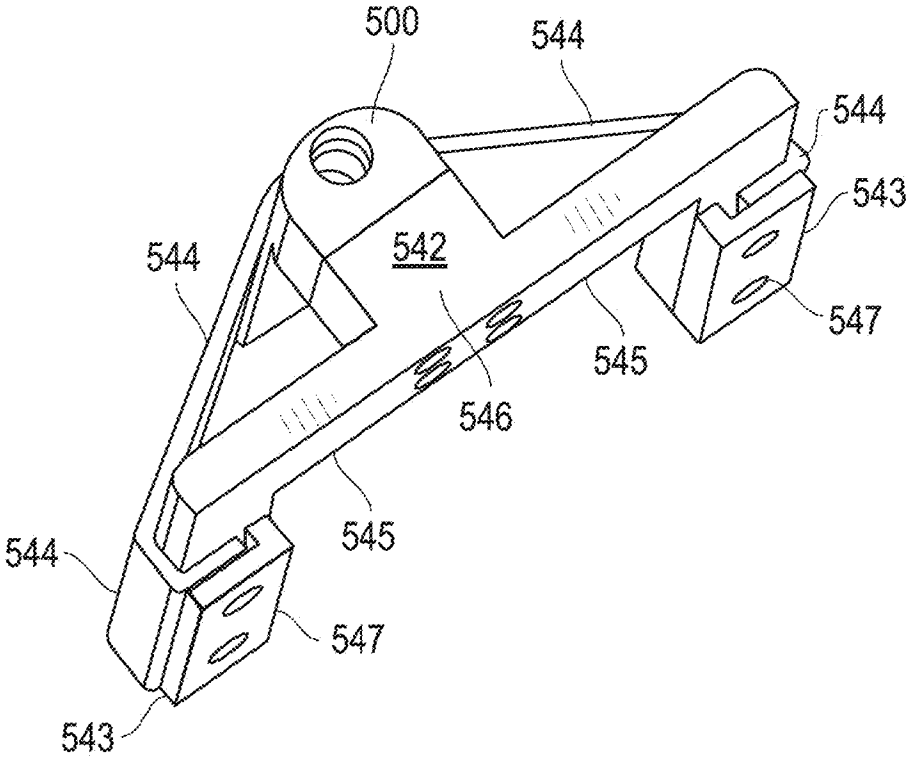
FIG. 18B includes another perspective view illustration of the assembly of FIG. 18A.
Figure 18A:
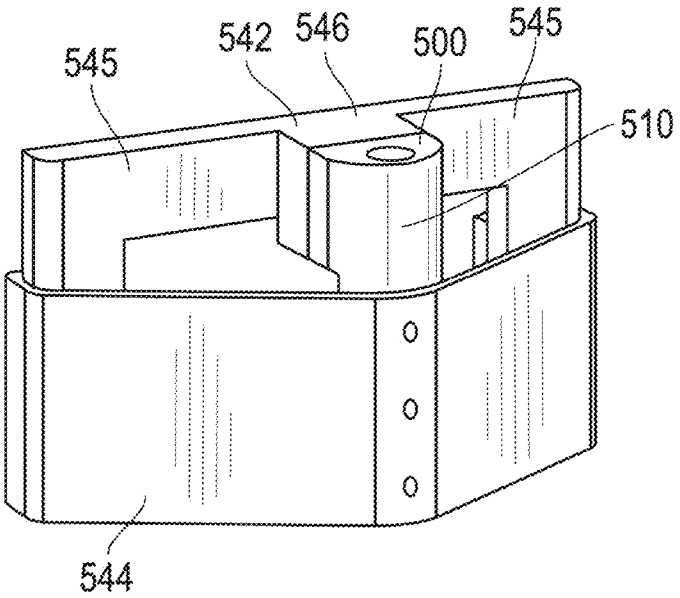
FIG. 18A includes a perspective view illustration of an assembly having a platen and a coating disposed over the platen according to an embodiment.

According to an embodiment, a coating can be disposed on a receiving surface of a platen. In an embodiment, the coating can be disposed on the receiving surface by spraying, dip-coating, deposition, electroplating, one or more adhesives, or a combination thereof. In a non-limiting embodiment, the coating can be disposed on the receiving surface by a fastening system or fastener, such as by one or more clips, screws, plates, clamps, brackets, or a combination thereof. For example, FIG. 14B includes a bottom-up perspective view illustration of the platen 500 of FIG. 14A, in which the coating 513 is disposed on the receiving surface 510 by a clamp 540 attached to the bottom surface 525 of the platen 500. The a portion of the coating 513 is frictionally secured between the clamp 540 and the bottom surface 525 of the platen through a clamping force provided at least in part by screws 541 retaining the clamp 540 to the bottom surface 525. As illustrated in FIGS. 18A and 18B, a coating 544 can be disposed on the platen 500 by a bracket 542. The bracket 542 can expose a relatively large surface area of the coating 544 by retaining distal ends of the coating 544 on opposite arms 545 extending outwardly from a central portion 546 of the bracket 542, as illustrated. The distal ends of the coating 544 are frictionally secured between the clamps 543 and bottom surfaces 546 of the bracket through a clamping force provided at least in part by screws 547 retaining the clamps 543 to the bottom surface 546 of the bracket 542.

Figure 18D:
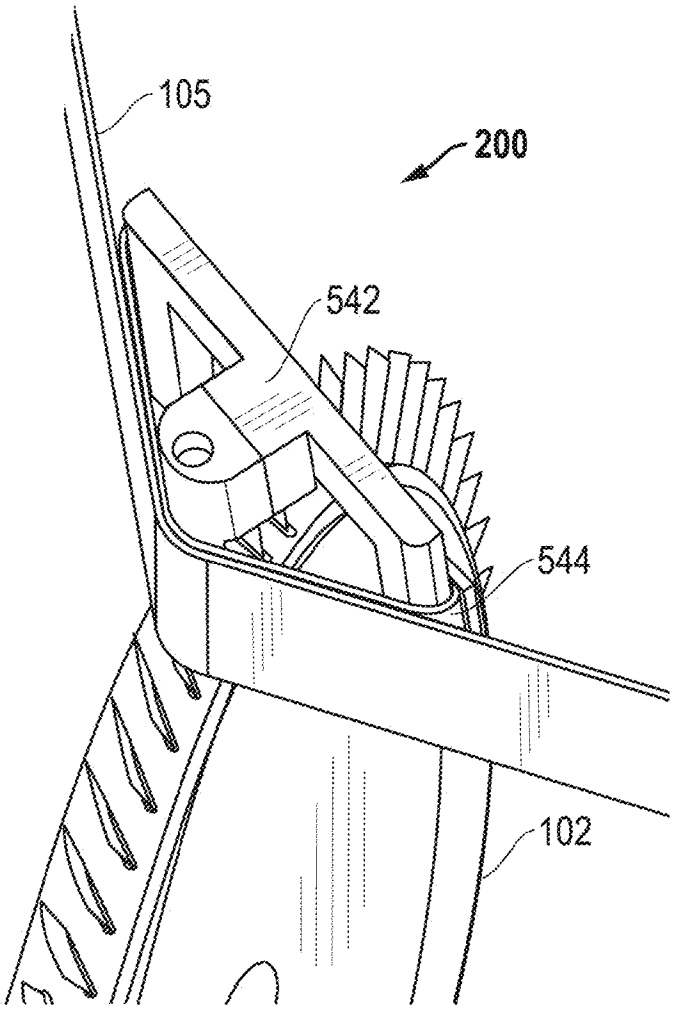
FIG. 18D includes another perspective view illustration of the system of FIG. 18C.
Figure 18C:
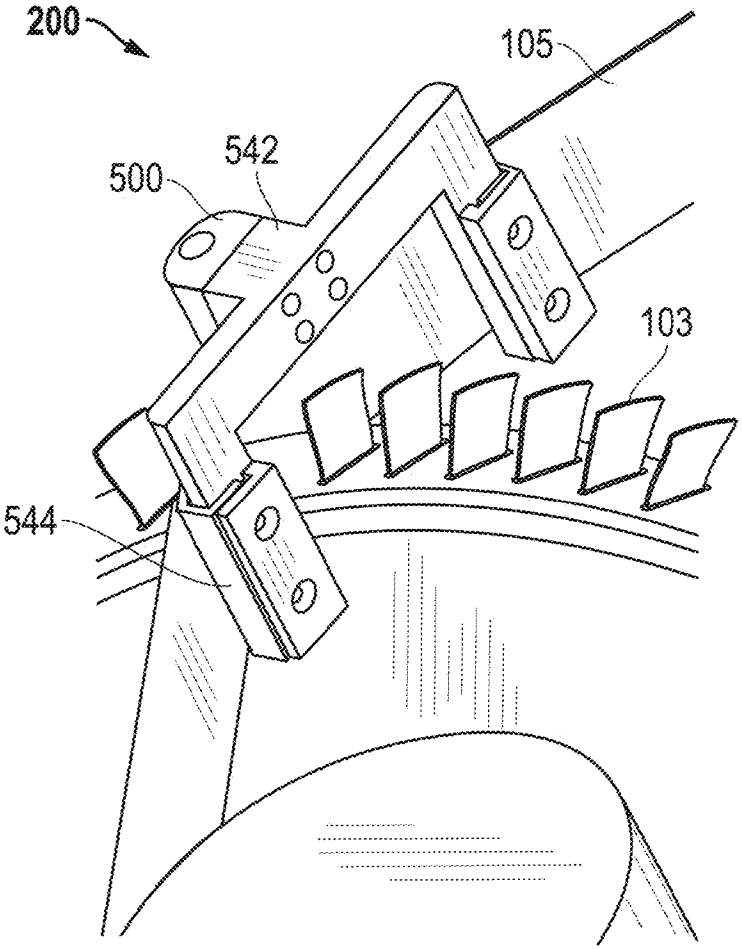
FIG. 18C includes a perspective view illustration of a system for removing material from a workpiece using an assembly having a platen and a coating disposed over the platen according to an embodiment.

FIGS. 18C and 18D include a perspective view illustrations of a system for removing material from a workpiece using an assembly having platen and a coating disposed over the platen according to an embodiment. Similar to system 100 discussed herein, the system 200 can include a translation assembly configured for translation of a coated abrasive 105, and bracket 542 to assist in guiding the coated abrasive 105 along a particular pathway for contacting at least a portion of the workpiece 102 to conduct a material removal operation. As illustrated, the system 200 can include a workpiece 102, which in certain embodiments, may be a rotor with a plurality of blades 103 extending radially from the periphery of the rotor.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

Embodiments

Embodiment 1. A method of removing material from a workpiece comprising: moving a coated abrasive over a receiving surface of a platen, the receiving surface comprising at least one opening configured for the flow of an ejection material therethrough; moving the platen and workpiece relative to each other to contact the coated abrasive to the workpiece and removing material from the workpiece; and controlling a flow pressure for the ejection material through the at least one opening during removing material from the workpiece, wherein the flow pressure of the ejection material is adjusted based on at least one of the operation parameters from the group: a translation rate of the coated abrasive over the receiving surface; the weight of the coated abrasive; a material removal rate; a coefficient of friction between the coated abrasive and the platen; a tension on the coated abrasive; or a combination thereof.

Embodiment 2. A method of removing material from a workpiece comprising: moving a coated abrasive over a receiving surface of a platen, the receiving surface comprising at least one opening configured for the flow of an ejection material therethrough; moving the platen and workpiece relative to each other to contact the coated abrasive to the workpiece and removing material from the workpiece; and controlling a flow pressure for the ejection material through the at least one opening during removing material from the workpiece, wherein the flow pressure of the ejection material is within a range of at least 1 psi and not greater than 100 psi.

Embodiment 3. A method of removing material from a workpiece comprising: moving a coated abrasive over a receiving surface of a platen, the receiving surface comprising at least one opening configured for the flow of an ejection material therethrough; moving the platen and workpiece relative to each other to contact the coated abrasive to the workpiece and removing material from the workpiece; and controlling a flow pressure relative to a translation rate of the coated abrasive during removing material from the workpiece.

Embodiment 4. The method of any one of embodiments 1, 2, and 3, wherein the coated abrasive comprises an abrasive surface and a non-abrasive surface, and wherein the abrasive surface is configured to contact the workpiece and conduct a material removal operation.

Embodiment 5. The method of any one of embodiments 1, 2, and 3, wherein the coated abrasive comprises backing, at least one adhesive layer, and abrasive particles secured to the backing using the at least one adhesive layer.

Embodiment 6. The method of any one of embodiments 1, 2, and 3, wherein the flow pressure is controlled based on a coefficient of friction between the coated abrasive and the receiving surface of the platen.

Embodiment 7. The method of any one of embodiments 1, 2, and 3, wherein during removing material from the workpiece, the flow pressure is adjusted to control a coefficient of friction between the receiving surface and the coated abrasive.

Embodiment 8. The method of any one of embodiments 1 and 3, wherein during removing material from the workpiece, the flow pressure of the ejection material is within a range of at least 1 psi and not greater than 100 psi.

Embodiment 9. The method of any one of embodiments 1, 2, and 3, wherein the workpiece comprises at least one non-linear contour.

Embodiment 10. The method of embodiment 9, wherein the workpiece comprises a curved surface having a radius of curvature (RCw).

Embodiment 11. The method of embodiment 9, wherein the receiving surface of the platen has a substantially complementary non-linear contour relative to the non-linear contour of the workpiece.

Embodiment 12. The method of embodiment 9, wherein the receiving surface of the platen has a substantially complementary radius of curvature (RCp) relative to the radius of curvature (RCw) of the workpiece.

Embodiment 13. The method of any one of embodiments 1, 2, and 3, wherein the workpiece comprises a metal or metal alloy Embodiment 14. The method of embodiment 13, wherein the workpiece comprises a nickel-based superalloy Embodiment 15. The method of any one of embodiments 1, 2, and 3, wherein the workpiece comprises a rotor having a first surface having a concave contour and a second surface having a convex contour Embodiment 16. The method of any one of embodiments 1, 2, and 3, wherein the material removal operation includes: moving the coated abrasive into contact with a first surface of the workpiece having a concave contour and removing material from the first surface; and moving the coated abrasive into contact with a second surface of the workpiece having a convex contour and removing material from the second surface Embodiment 17. The method of embodiment 16, wherein moving the coated abrasive into contact with the workpiece includes an automated process.

Embodiment 18. The method of embodiment 16, wherein during removing material from the first surface having a concave contour, the coated abrasive is translated between the receiving surface and the workpiece.

Embodiment 19. The method of embodiment 16, wherein during removing material from the first surface, at least a portion of the platen extends into a cavity defined by the concave contour.

Embodiment 20. The method of embodiment 16, wherein during removing material from the first surface, the receiving surface of the platen is immediately adjacent the first surface having a concave contour.

Embodiment 21. The method of embodiment 16, wherein during removing material from the second surface of the workpiece having a convex contour, the platen is laterally shifted and spaced apart from the second surface.

Embodiment 22. The method of embodiment 16, wherein during removing material from the second surface of the workpiece having a convex contour, the coated abrasive is translated over the second surface and is deformed over the convex contour.

Embodiment 23. The method of any one of embodiments 1, 2, and 3, wherein the ejection material is a gas, a liquid, or a combination thereof.

Embodiment 24. The method of any one of embodiments 1, 2, and 3, wherein the ejection material includes air.

Embodiment 25. A system for conducting a material removal operation comprising:

a platen having a receiving surface including at least one opening configured for the flow of an ejection material therethrough; and a coated abrasive configured to be translated over the receiving surface of the platen; and movement assembly configured to move the platen relative to a workpiece and control a distance between the coated abrasive and the workpiece for a material removal operation.

Embodiment 26. An article comprising:

a platen comprising:

a body and a receiving surface configured for movement of a coated abrasive thereon;

at least one opening intersecting the receiving surface and configured to allow for flow of an ejection material therethrough; and at least one coating disposed over at least a portion of the receiving surface of the platen.

Embodiment 27. The article of embodiment 26, wherein the coating comprises an opening corresponding with the at least one opening on the receiving surface of the platen.

Embodiment 28. The article of embodiment 26, wherein the coating comprises a plurality of layers including a first layer overlying the receiving surface and a second layer overlying first layer.

Embodiment 29. The article of embodiment 28, wherein first layer comprises a polymer, a metal, a ceramic, or any combination thereof.

Embodiment 30. The article of embodiment 28, wherein the first layer comprises a Shore A hardness of not greater than 100 A.

Embodiment 31. The article of embodiment 30, wherein the first layer comprises a Shore A hardness of at least 20 A.

Embodiment 32 The article of embodiment 28, wherein the first layer comprises a rubber material, or wherein the first layer consists essentially of a rubber material.

Embodiment 33. The article of embodiment 28, wherein the first layer comprises a thickness of at least 10 mm and not greater than 100 mm.

Embodiment 34. The article of embodiment 28, wherein the second layer comprises a polymer, a metal, a ceramic, or any combination thereof.

Embodiment 35. The article of embodiment 28, wherein the second layer comprises coefficient of friction of less than 0.5.

Embodiment 36. The article of embodiment 28, wherein the second layer comprises carbon, wherein the second layer consists essentially of carbon, wherein the second layer consists of graphite or polytetrafluoroethylene (PTFE).

Embodiment 37. The article of embodiment 28, wherein the second layer comprises a thickness of at least 1 mm and not greater than 100 mm.

Embodiment 38. The article of embodiment 28, wherein the second layer comprises a thickness that is less than a thickness of the first layer.

Embodiment 39. The article of embodiment 28, wherein the second layer is adhered to the first layer via at least one adhesive.

Embodiment 40. The article of embodiment 28, wherein the second layer is directly contacting the first layer.

Embodiment 41. The article of embodiment 28, further comprising a third layer disposed between the first layer and the second layer.

Embodiment 42. The article of embodiment 28, wherein the first layer comprises a plurality of films, and wherein at least one film of the plurality of films comprises a material having a Shore A hardness of not greater than 100A.

Embodiment 43. An article comprising:

a platen comprising a body and a receiving surface configured for movement of a coated abrasive thereon, and at least two openings intersecting the receiving surface and configured to allow for flow of an ejection material therethrough.

Embodiment 44. An article comprising:

a platen comprising a body and a receiving surface configured for movement of a coated abrasive thereon, and at least one opening intersecting the receiving surface and configured to allow for flow of an ejection material therethrough, wherein the receiving surface comprises a non-linear contour along a lateral cross-sectional plane of the body.

Embodiment 45. An article comprising:

a platen comprising:

a body and a receiving surface configured for movement of a coated abrasive thereon; at least one opening intersecting the receiving surface and configured to allow for flow of an ejection material therethrough; and an inlet configured to provide the ejection material to an interior passageway within the body, and wherein the inlet is positioned on a side surface of the body.

Embodiment 46. The article of any one of embodiments 43 and 44, further comprising an inlet configured to provide the ejection material to an interior passageway within the body.

Embodiment 47. The article of any one of embodiments 45 and 46, wherein the interior passageway is disposed within the body of the platen and is fluidly connected to at least one of the openings and the inlet positioned on a side surface of the body.

Embodiment 48. The article of embodiment 47, wherein the inlet is positioned on a side surface of a distal end of the platen.

Embodiment 49. The article of embodiment 47, wherein the inlet is positioned on a side surface defining a width of the platen.

Embodiment 50. The article of embodiment 47, wherein the passageway comprises a plurality of channels, and wherein each channel intersects at least one opening.

Embodiment 51. The article of embodiment 50, wherein at least one of channels of the plurality of channels includes a different cross-sectional area compared to another one of the channels of the plurality of channels.

Embodiment 52. The article of embodiment 50, wherein the plurality of channels includes a first and a second channel, and wherein the first channel includes a cross-sectional width that is at least 10% less than the a cross-sectional width of the first channel.

Embodiment 53. The article of any one of the above embodiments, wherein the platen comprises at least three openings, and wherein the at least three openings are positioned in a straight line with respect to each other, or a triangular orientation with respect to each other.

Embodiment 54. The article of any one of the above embodiments, wherein the platen comprises at least four openings, and wherein the at least four openings are positioned in a random orientation, in an L-shaped orientation, in a circular orientation, in a square orientation, or in a rectangular orientation.

Embodiment 55. The article of any one of embodiments 26 and 43-45, wherein the body includes a maximum height defined as the maximum distance between a bottom surface of the body and the receiving surface of the body; and wherein the at least two openings are positioned at the maximum height of the receiving surface.

Embodiment 56. The article of any one of embodiments 26 and 43-45, wherein the body includes a maximum height defined as the maximum distance between a bottom surface of the body and the receiving surface of the body, a minimum height defined as the minimum distance between the bottom surface of the body and the receiving surface of the body, and wherein at least one of the at least two openings is positioned between the minimum height and the maximum height of the receiving surface.

Embodiment 57. The article of any embodiments 26 and 43-45, wherein the receiving surface comprises a non-linear contour along a lateral cross-sectional plane of the body, Embodiment 58. The article of embodiment 57, wherein the non-linear contour comprises a convex contour.

Embodiment 59. The article of any embodiments 26 and 43-45, wherein the body comprises a thickness defined as the distance between a bottom surface of the body and the receiving surface of the body as viewed from a lateral cross-sectional plane of the body, and wherein the thickness varies along the lateral cross-sectional plane of the body.

Embodiment 60. The article of embodiment 59, wherein the thickness does not vary along a longitudinal cross-sectional plane of the body.

EXAMPLE

A first coated abrasive belt (S1) commercially available as Norax X30-U243 from Saint-Gobain Abrasives Corporation was attached to a belt sanding machine commercially available as Model #67912 from Dynabrade Corporation. The machine was altered to include an adapter configure to incorporate a platen having three openings within a receiving surface, each of the openings having a diameter of approximately 1.6 mm, and longitudinally spaced apart from each other along the longitudinal axis of the receiving surface by a distance of 1.5 cm. The receiving surface had a radius of curvature of approximately 1.5 cm.

A first test (T1) was conducted using the first coated abrasive belt S1, wherein the belt was run on the machine and over the receiving surface platen at a translation rate of 25 m/s. The temperature of the abrasive surface of the coated abrasive belt belt was measured at three different positions using an infrared thermometer device commercially available from Commercial Electric Corporation. The three different positions include a left third of the coated abrasive belt, a middle third, and a right third, wherein the middle third is positioned between the left third and the right third in the direction of the width of the belt. During the first test, an ejection material of air was flowed through the platen and through the holes using a flow pressure of 10 psi. The test was conducted for a duration of 20 minutes.

A second test (T2) was conducted according to the testing conditions of the first test using a second coated abrasive belt (S2) commercially available as Norax X30-U264 from Saint-Gobain Corporation.

A third test (T3) was conducted using the same set up as the second test, including the use of the second coated abrasive belt S2, but using a second set of test conditions including a flow pressure of 15 psi, an ejection material of air, a grinding duration of 10 minutes.

A fourth test (T4) was conducted using the second coated abrasive belt S2 without any air or flow pressure through the openings in the platen. The test was stopped after 1 minute due to rapidly increasing temperatures of the second coated abrasive belt S2.

FIG. 5 includes a plot of temperature versus placement on the workpiece where the respective grinding tests were conducted. As illustrated, the fourth grinding test had significantly increasing temperature and ceased after 1 minute. The first, second and third grinding tests demonstrate suitable temperatures at the coated abrasive for the duration of the test.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in reference books and other sources within the structural arts and corresponding manufacturing arts.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. An article, comprising:

a platen comprising:

a body having a convex receiving surface configured for movement of a coated abrasive thereon;

at least one opening intersecting the convex receiving surface and configured to allow for flow of an ejection material therethrough; and a coating is disposed over and in direct contract with the convex receiving surface of the platen, and wherein the coating comprises a Shore A hardness of not greater than 100A;

wherein the body comprises a thickness defined as a distance between a bottom surface of the body and the convex receiving surface of the body as viewed from a lateral cross-sectional plane of the body, and wherein the body comprises a first uniform thickness extending from a first distal end of the body and a second uniform thickness extending from a second opposing distal end of the body, such that the thickness varies along a longitudinal cross-sectional plane of the body over which the coated abrasive moves.

2. The article of claim 1, wherein the coating comprises an opening corresponding with the at least one opening on the convex receiving surface of the platen.

3. The article of claim 1, wherein the platen comprises at least three openings, wherein the coating comprises at least three openings corresponding with the at least three openings on the convex receiving surface of the platen, and wherein the at least three openings are positioned in a straight line or a triangular orientation with respect to each other.

4. The article of claim 1, wherein the coating comprises a plurality of layers including a first layer overlying and in direct contact with the convex receiving surface and a second layer overlying and in direct contact with the first layer.

5. The article of claim 4, wherein the first layer comprises a material selected from the group consisting of an elastic polymer, felt, cork, and rubber.

6. The article of claim 4, wherein the second layer comprises a material selected from the group consisting of graphite or polytetrafluoroethylene (PTFE).

7. The article of claim 4, wherein the second layer comprises a coefficient of friction of less than 0.5.

8. The article of claim 4, wherein the second layer comprises a thickness of at least 1 mm and not greater than 5 mm.

9. The article of claim 4, wherein the second layer comprises a thickness that is less than a thickness of the first layer.

10. The article of claim 4, wherein the second layer is adhered to the first layer via at least one adhesive.

11. The article of claim 4, wherein the second layer is directly contacting the first layer.

12. The article of claim 4, wherein the first layer comprises a material having a Shore A hardness of not greater than 100A.

13. An article, comprising:

a platen comprising a body having a convex receiving surface configured for movement of a coated abrasive thereon;

at least two openings intersecting the convex receiving surface and configured to allow for flow of an ejection material therethrough; and a coating disposed over the convex receiving surface of the platen, wherein the coating comprises a plurality of layers including a first layer overlying and in direct contact with the convex receiving surface and a second layer overlying and in direct contact with the first layer, wherein the first layer comprises a Shore A hardness of not greater than 100A;

wherein the body comprises a thickness defined as distance between a bottom surface of the body and the convex receiving surface of the body as viewed from a lateral cross-sectional plane of the body, and wherein the body comprises a first uniform thickness extending from a first distal end of the body and a second uniform thickness extending from a second opposing distal end of the body, such that the thickness varies along a longitudinal cross-sectional plane of the body over which the coated abrasive moves.

14. The article of claim 13, further comprising an inlet configured to provide the ejection material to an interior passageway within the body.

15. The article of claim 14, wherein the interior passageway is disposed within the body of the platen and is fluidly connected to at least one of the openings and the inlet, wherein the inlet is positioned on a side surface of the body.

16. The article of claim 14, wherein the inlet is positioned on a side surface of a distal end of the platen.

17. The article of claim 1, wherein the body includes a maximum height defined as the maximum distance between a bottom surface of the body and the convex receiving surface of the body, a minimum height defined as the minimum distance between the bottom surface of the body and the convex receiving surface of the body, and wherein the at least one opening is positioned between the minimum height and the maximum height of the convex receiving surface.

18. A system, comprising:

a translation assembly configured for translation of a coated abrasive;

a platen comprising a body having a receiving surface configured for movement of the coated abrasive thereon;

a plurality of openings intersecting the receiving surface and configured to allow for flow of an ejection material therethrough, wherein the receiving surface comprises a convex contour along a lateral cross-sectional plane of the body; and a coating disposed over and in direct contact with the receiving surface of the platen, and wherein the coating comprises a Shore A hardness of not greater than 100A;

wherein the body comprises a thickness defined as a distance between a bottom surface of the body and the convex receiving surface of the body as viewed from a lateral cross-sectional plane of the body, and wherein the body comprises a first uniform thickness extending from a first distal end of the body and a second uniform thickness extending from a second opposing distal end of the body, such that the thickness varies along a longitudinal cross-sectional plane of the body over which the coated abrasive moves.

* * * * *